US008657396B2

(12) United States Patent
Ogawa et al.

(10) Patent No.: US 8,657,396 B2
(45) Date of Patent: Feb. 25, 2014

(54) INK JET PRINTING APPARATUS

(75) Inventors: Masashi Ogawa, Kawasaki (JP); Kenjiro Watanabe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 335 days.

(21) Appl. No.: 13/033,815

(22) Filed: Feb. 24, 2011

(65) Prior Publication Data

US 2011/0216112 A1 Sep. 8, 2011

(30) Foreign Application Priority Data

Mar. 2, 2010 (JP) ..... 2010-045880

(51) Int. Cl.
*B41J 2/195* (2006.01)
*B41J 29/393* (2006.01)

(52) U.S. Cl.
USPC ..... 347/7; 347/5; 347/19

(58) Field of Classification Search
CPC ..... B41J 2202/17; B41J 2/17546
USPC ..... 347/5–19, 84, 85, 86, 87
IPC ..... B41J 2/195, 29/393
See application file for complete search history.

(56) References Cited

U.S. PATENT DOCUMENTS 6,666,540 B2 12/2003 Asauchi
7,237,881 B2 7/2007 Hayasaki et al.
7,455,382 B2 11/2008 Kuribayashi et al.
2002/0126170 A1 * 9/2002 Akama et al. ..... 347/19
2003/0011654 A1 1/2003 Asauchi
2006/0139422 A1 * 6/2006 Hatasa et al. ..... 347/86
2006/0244795 A1 * 11/2006 Hayasaki et al. ..... 347/86
2006/0284917 A1 * 12/2006 Kuribayashi et al. ..... 347/19
2008/0001985 A1 * 1/2008 Hatasa et al. ..... 347/19
2008/0106757 A1 * 5/2008 Asauchi ..... 358/1.15
2010/0002040 A1 * 1/2010 Ochiai et al. ..... 347/19

FOREIGN PATENT DOCUMENTS

JP 2002-370378 A 12/2002
JP 2004-058645 A 2/2004

* cited by examiner

*Primary Examiner* — Manish S Shah
*Assistant Examiner* — Roger W Pisha, II
(74) *Attorney, Agent, or Firm* — Fitzpatrick, Cella, Harper & Scinto

(57) ABSTRACT

There is a case where, in the individual tank number checking processing, usually it is determined that individual tank number agreement can not be confirmed due to a collision of response signals from two tanks. However, due to individual differences among main body side control circuit threshold values and the like, there may be a case that an agreement of the individual tank numbers is confirmed. In response to this, the tank that has the individual tank number whose agreement could be confirmed is put in a sleep state, and because a control code is sent, the other tank designated with color ID is able to return its individual tank number, and the main body side control circuit detects its individual tank number. Based on this it is possible to determine that multiple ink tanks with the same color ID are mounted.

18 Claims, 22 Drawing Sheets

START

COLOR ID TABLE CREATION — S301

COLOR ID INSUFFICIENCY ? — S302

YES

NO

MOUNTING NORMAL FLAG ON — S303

END

COLOR ID SELECTION — S304

INDIVIDUAL TANK NO. CHECK — S305

RESPONSE PRESENT? — S306

NO

YES

MULTIPLE MOUNTING "PRESENT" TABLE ENTRY FOR SELECTED COLOR ID — S307

ERROR FLAG ON — S308

SLEEP OPERATION — S309

INDIVIDUAL TANK NO. CHECK — S310

NORMAL MOUNTING

| | C | M | Y | K | PGK |
|---|---|---|---|---|---|
| ID PRESENT/ABSENT | PRESENT | PRESENT | PRESENT | PRESENT | PRESENT |
| MULTIPLE PRESENT/ABSENT | ABSENT | ABSENT | ABSENT | ABSENT | ABSENT |

FIG.15A

M: NOT YET MOUNTED,
NO MULTIPLE MOUNTING

| | C | M | Y | K | PGK |
|---|---|---|---|---|---|
| ID PRESENT/ABSENT | PRESENT | ABSENT | PRESENT | PRESENT | PRESENT |
| MULTIPLE PRESENT/ABSENT | ABSENT | ABSENT | ABSENT | ABSENT | ABSENT |

FIG.15B

M: NOT YET MOUNTED,
C: MULTIPLE MOUNTING

| | C | M | Y | K | PGK |
|---|---|---|---|---|---|
| ID PRESENT/ABSENT | PRESENT | ABSENT | PRESENT | PRESENT | PRESENT |
| MULTIPLE PRESENT/ABSENT | PRESENT | ABSENT | ABSENT | ABSENT | ABSENT |

FIG.15C

| FIG.16A |
| --- |
| FIG.16B |

INK JET PRINTING APPARATUS

BACKGROUND OF THE INVENTION

1. Field of the Invention

The present invention relates to ink jet printing apparatuses, and relates in particular to the determination of the ink tank mounting state.

2. Description of the Related Art

As for ink jet type printing apparatuses such as ink jet printers and the like, techniques are known that determine the mounted state of the respective ink tanks by way of using a line that is common to multiple ink tanks mounted on a carriage (a so-called bus connection wiring) (Japanese Patent Laid-Open Nos. 2002-370378, 2004-058645). The checking of whether ink tanks are mounted/not yet mounted by way of using identification information corresponding to the ink colors stored in the ink tanks is described in these documents.

As for an ink tank mounting determination structure using the aforementioned bus connection wiring, it is further preferable that it be capable of determining whether or not multiple ink tanks of the same color are mistakenly mounted. By being able to make this type of determination, for example, it is possible to notify the user of the case that the ink tanks are incorrectly mounted, and it is possible to notify the user of the ink tank that should be removed. Thereby, it is possible to improve the usability of the apparatus.

In the following manner, for example, it is possible to determine whether multiple ink tanks of the same color are mistakenly mounted, in a configuration using a bus connection wiring. This determination method will be explained by making use of FIG. 19 and FIG. 20. FIG. 19 and FIG. 20 illustrate a printing apparatus using ink tanks totaling four colors; cyan (C) magenta (M), yellow (Y) and black (K). A mounting unit of C, M, Y and K ink tanks, electrical contacts provided on the respective mounts, a common wiring electrically connected in common with these electrical contacts, and a control circuit that performs determinations such as those explained below by sending information (data, signals) to the common wiring and receiving information through the common wiring, are provided on the printing apparatus main body side. On the other hand, control circuits and electrical contacts are provided on the ink tank side. In a state where the ink tanks are mounted in the ink tank mounts (mounting portions), the tank side control circuits and the main body side control circuit electrically connect via the electrical contacts, and herewith both (the tank side control circuits and the main body side control circuit) become capable of information communication. Thus, as explained below, by performing the transfer of color ID (color identification information) and individual tank number information between both of them, it is possible to check whether ink tanks of the same color are mistakenly mounted. It should be noted that FIG. 19 illustrates a case where four colored (CMYK) ink tanks are mounted normally and FIG. 20 illustrates a case where two C ink tanks have been mistakenly mounted.

First, stored identification information corresponding to the ink colors (hereinafter also referred to as color ID) is sent from the main body side control circuit of the printing apparatus, through the common wiring, to (the control circuits (also referred to hereinafter as ink tank side control circuits) of) the ink tanks. Next, each of the tank side control circuits compares the received color ID to the color ID stored in its own memory, and in the case where there is color ID agreement returns that color ID to the main body side control circuit. For example, in the case where the main body side control circuit has sent a Y-ID, each of the C, M, Y and K ink tanks receive the Y-ID, but because among these only the Y ink tank has color ID agreement, only the control circuit of the Y ink tank returns a Y-ID to the main body side control circuit. Next, the main body side control circuit confirms the mounting of the ink tank based on the received color ID. Here, the main body side control circuit, in the case where color IDs of all of the ink tanks that should be mounted are received, determines that ink tanks of all of the colors are mounted. For example, in the case of FIG. 19, C, M, Y and K color IDs are sequentially sent from the C, M, Y, and K ink tanks to the main body side control circuit, and because the main body side control circuit receives color IDs of four colors, it can confirm the existence of ink tanks of four colors. On the other hand, in the case where, among the ink tanks that should be mounted, there is a color ID of an ink tank whose mounting can not be confirmed, that is, in the case where there is a color ID insufficiency of the ink tanks that should be mounted, an individual tank number checking processing is subsequently performed. For example, in the case of FIG. 20, an M-ID is not sent from the ink tank side to the main body side control circuit because an M ink tank is not mounted. Thus, because the main body side control circuit did not receive an M-ID it determines that there is a color ID insufficiency and transitions over to the individual tank number checking processing.

In the individual ink tank number checking processing, the main body side control circuit requests, from the tank side control circuit of each of the ink tanks whose color ID was confirmed, its individual tank numbers stored in its memory at the time that ink tank is manufactured. In response to this request, the tank side control circuit sends response signal that express the individual tank number stored in its memory to the main body side control circuit. Next, the main body side control circuit sends the received individual tank number to the ink tanks via the common wiring. In response to this, the tank side control circuits returns a response signal (the individual tank number) to the main body side control circuit in the case where there is agreement between the individual tank number sent from the main body side control circuit and the individual tank number stored in its own memory, and does not send a response signal in the case where there is not agreement.

Here, the main body side control circuit, in the case where individual tank numbers can be checked with respect to all of the confirmed color IDs (the presence of response signals), determines that the ink tank of the aforementioned insufficient color ID is not mounted (not yet mounted). On the other hand, the main body side control circuit, in the case where an individual tank number can not be checked for one of the ink tanks confirmed by color ID (the absence of a response signal), determines that a plurality of ink tanks of that color ID are mounted. For example, in the case of FIG. 20, as explained below using FIG. 1, the main body side control circuit determines that a plurality of C ink tanks are mounted because it can not confirm the individual tank number of the C tank 1 and C tank 2, confirmed by the C-ID.

FIG. 1 is a diagram explaining the above described individual tank number checking processing, which illustrates the response signals (individual tank number) output by the tank side control circuits of the respective ink tanks, and illustrates the obtained detection signal by that the main body side control circuit detects the response signals. More concretely, as an example, respective response signals and detected signal are shown for the case where two cyan ink tanks (C tank 1, C tank 2) are mounted. In FIG. 1 the individual tank number of C tank 1 is "01011010" and the individual tank number of C tank 2 is "01101011".

Thus, as described above, when the main body side control circuit requests an individual tank number by the cyan color ID, C tank 1 outputs a "01011010" individual tank number response signal and c tank 2 outputs a "01101011" individual tank number response signal. As a result of this, the main body side control circuit detects the signal shown in FIG. 1, which is formed from the so-called collision of the response signals from the two tanks. Here, usually, each of the sections of which the response signal is composed is at either a high or low voltage, but at the time when multiple response signals collide, in the case where the response signal from one of the tank side control circuits is high and the response signal from the other tank side control circuit is low, it becomes a voltage that is between them. At the corresponding section in the example signal shown in the figure, the intermediate voltage of the signal formed by the collision is 1.5V, half of 3.0V and 0V. Thus, in the case where a detection threshold value of the main body side control circuit is 1.3V, the main body side control circuit recognizes that the individual tank number of the signal obtained by the request is "01111011". Next, the main body side control circuit sends the individual tank number recognized as set forth above to the ink tanks having a cyan color ID and requests a response from the respective tanks according to whether or not there is individual tank number agreement. Neither of C tank 1 or C tank 2 responds to this because their individual tank numbers do not agree. As a result, the main body side control can determine that multiple ink tanks of the same color are mounted. It should be noted that the case in which individual tank numbers agree and there is a response of the agreement is the case where the individual tank number of the response signal requested and obtained is a signal wherein multiple response signals have not collided. That is, it is the case where, with respect to one color ID, an individual tank number has been sent from one ink tank. In this case, in the case where there is a color ID insufficiency, that is, in the case where all of the ink tanks that should be mounted are not mounted, it is possible to determine that the ink tank of the insufficient color ID is not yet mounted.

As explained above, in a structure using a bus connection wiring, it is possible to determine whether or not multiple ink tanks of the same color are mounted. However, there are cases where the intermediate voltage value of the response signal (detected signal) composed by a collision of multiple response signals is not always a constant value due to individual differences such as, for example, the production lots of the multiple tank side control circuits differing. In this case, there are occasions where the signal detected by the main body side control circuit, when multiple response signals from the tank side control circuits have collided, undesirably expresses the individual tank number of an ink tank. Also, there are occasions where the threshold value used by the main body side control circuit varies, albeit slightly, due to the characteristics of the electric circuit or value of the wire resistance. In this case, there are occasions where the threshold value undesirably differs according to individual differences such as the aforementioned circuit characteristics. Also in this case, in the same manner, there are occasions where the signal detected by the main body side control circuit, when multiple response signals from the tank side control circuits have collided, undesirably expresses the individual tank number of an ink tank in spite of the collision of response signals.

FIG. 2 and FIG. 3 are diagrams explaining such signal detection, and are similar to FIG. 1. FIG. 2 illustrates a case where the tank side control circuit characteristic difference between C tank 1 and C tank 2 is comparatively large. More specifically, due to the response signal from the tank side control circuit of C tank 1 with a comparatively high output impedance and the response signal from the tank side control circuit of C tank 2 with a comparatively low output impedance, the intermediate voltage of the signal detected when these collide becomes 1.7V or 1.3V according to the highs and lows of the respective signals. At this time, in the case where the main body side control circuit threshold value is the same 1.3V as the example of FIG. 1, the individual tank number acquired by the main body side control circuit becomes "01011010". This individual tank number is the same as the individual tank number of C tank 1 and thus individual tank numbers end up agreeing. As a result of this, in spite of the fact that multiple ink tanks of the same color ID are mounted, it is determined that the ink tank of the insufficient color ID is not yet mounted. For example, in the case of FIG. 20 described above, in spite of the fact that multiple C ink tanks are mounted, it is determined that the M ink tank is not yet mounted without determining that multiple C ink tanks are mounted. This determined result is certainly not wrong because it is a fact that the M ink tank is not yet mounted. However, because multiple C ink tanks are mounted, it is preferable to increase determination accuracy such that this mounting state can be detected. Also, usability would be improved if it were possible to notify the user with a multiple ink tank mounting error and a tank not yet mounted error distinctively.

FIG. 3 illustrates a case where main body side control circuit characteristics of printing apparatus main bodies differ, and the threshold value, when detecting response signals, undesirably differs in accordance therewith. More specifically, in the case where the intermediate voltage of the signal detected when there is a collision of response signals becomes the same 1.3V or 1.7V as the example shown in FIG. 2, a case is shown where the threshold value is not 1.3V but rather 1.6V due to the characteristics of the main body side control circuit that detects the response signal. In this case as well, the individual tank number acquired by the main body side control circuit becomes "01011010". This individual tank number becomes the same individual tank number as C tank 1, and in spite of the fact that multiple ink tanks of the same color are mounted, it ends up being determined that the ink tank of the insufficient color ID is not yet mounted, due to individual tank number agreement.

In this way, the method of determining whether multiple ink tanks of the same color are mounted, described at FIG. 1, has a problem wherein the determination accuracy is decreased due to differences among tank side control circuits and the characteristics of main body side control circuits.

SUMMARY OF THE INVENTION

An object of the present invention is to provide an ink jet printing apparatus that is capable of improving the accuracy when determining whether multiple ink tanks of the same color are mounted. It is also another object of the present invention to improve usability by making it possible to determine with high accuracy whether there is a multiple ink tank error or an error wherein an ink tank is not yet mounted, and to notify the user of that result.

In a first aspect of the present invention, there is provided an ink jet printer, comprising: a plurality of ink tanks, wherein each of the plurality of ink tanks has (i) a memory that stores (a) ink identification information for identifying a type of ink contained in the ink tank and (b) individual tank information of the ink tank, and (ii) a controller; a mounting portion in which the plurality of ink tanks are detachably mounted; common wiring capable of electrically connecting in common with the tank control units of the plurality of ink tanks mounted in the mounting portion; and a controlling unit capable of executing a determination processing to (i) send a signal that contains a command and ink identification information for specifying the ink tank that should respond to the command, to the controllers through the common wiring, (ii) receive a response signal from one or more of the ink side control units in response to the command, wherein the response signal is the resulting signal received through the common wiring, and (iii) determine a state of mounting of the ink tanks in respect to the mounting portion based on information contained in the received response signal; wherein the controlling unit and the respective controllers of the plurality of ink tanks execute a determination process including: a first step wherein the controlling unit sends a first information signal that contains selected ink identification information and a first command for requesting a transmission of individual tank information stored in the memory of the ink tank specified by the ink identification information, to the ink controllers through the common wiring; a second step wherein each of the one or more controllers that stores, in its memory, the same ink identification information as the ink identification information contained in the first information signal, sends, in response to the first command, a response signal that contains the ink identification information and the individual tank information stored in its memory to the controlling unit through the common wiring; a third step wherein the controlling unit sends a second information signal that contains (i) the selected ink identification information, (ii) the individual tank information contained in the response signal sent through the common wiring from the one or more controllers in response to the first command and (iii) a second command that requests a response as to whether or not the individual tank information contained in the response signal agrees with the individual tank information stored in the memory of the ink tank specified by the ink identification information, to the ink controllers through the common wiring; a fourth step wherein each of the one or more controllers that stores, in its memory, the same ink identification information as the ink identification information contained in the second information signal, sends, in response to the second command, a response signal that contains the ink identification information and the individual tank information stored in its memory to the controlling unit through the common wiring in the case where the individual tank information contained in the second information signal and the individual tank information stored in its memory agree with each other, and does not send a response signal in the case where the individual tank information and the individual tank information stored in its memory do not agree with each other; a fifth step wherein the controlling unit sends, when the controlling unit has received the response signal through the common wiring from the one or more controllers in response to the second command, a third information signal that contains (i) the selected ink identification information, (ii) the individual tank information contained in the received response signal and (iii) a third command for turning the controller into a state wherein it can not send a response signal, to the ink controllers through the common wiring; a sixth step wherein, in response to the third command, the controller that stores in its memory ink identification information and individual tank information that are respectively the same as the ink identification information and individual tank information contained in the third information signal, turns itself into a state wherein it can not send a response signal; a seventh step wherein, after the fifth step, the controlling unit sends a fourth information signal that contains the selected ink identification information and a fourth command for requesting a transmission of individual tank information stored in the memory of the ink tank specified by the selected ink identification information to the ink controllers through the common wiring; an eighth step wherein in the case where the controller that stores, in its memory, the same ink identification information as the ink identification information contained in the fourth information signal is present, the controller sends, in response to the fourth command, a response signal that contains the ink identification information and the individual tank information stored in its memory to the controlling unit through the common wiring; and a ninth step wherein the controlling unit determines that a plurality of ink tanks identified by the ink identification information are mounted in the mounting portion in the case where the controlling unit receives a response signal containing ink identification information and individual tank information from the controllers in response to the fourth command, and determines that a plurality of ink tanks identified by the ink identification information are not mounted in the mounting portion in the case where the controlling unit does not receive a response signal from the controllers in response to the fourth command.

In a second aspect of the present invention, there is provided an ink jet printer, comprising: a mounting portion in which a plurality of ink tanks are detachably mounted, each of the plurality of ink tanks having (i) a memory that stores at least (a) ink identification information for identifying a type of ink contained in the tank and (b) individual tank information of the ink tank, and (ii) a controller; common wiring capable of electrically connecting in common with the tank control units of the plurality of ink tanks mounted in the mounting portion; and a controlling unit capable of executing a determination processing to (i) send a signal that contains a command and ink identification information for specifying the ink tank that should respond to the command, to the controllers through the common wiring, (ii) receive a response signal from one or more of the ink side control units in response to the command, wherein the response signal is the resulting signal received through the common wiring, and (iii) determine a state of mounting of the ink tanks in respect to the mounting portion based on information contained in the received response signal; wherein the controlling unit executes a determination processing including: a first step of sending a first information signal that contains selected ink identification information ands first command for requesting a transmission of individual tank information stored in the memory of the ink tank specified by the ink identification information, to the ink controllers through the common wiring; a second step of sending a second information signal that contains (i) the selected ink identification information, (ii) the individual tank information contained in the response signal sent through the common wiring from the one or more controllers in response to the first command and (iii) a second command that requests a response as to whether or not the individual tank information contained in the response signal agrees with the individual tank information stored in the memory of the ink tank specified by the ink identification information, to the ink controllers through the common wiring; a third step of sending, when the response signal is received through the common wiring from the one or more controllers in response to the second command, a third information signal that contains (i) the selected ink identification information, (ii) the individual tank information contained in the received response signal and (iii) a third command for turning the controller into a state wherein it can not send a response signal, to the ink controllers through the common wiring; a fourth step of sending, after the third step, a fourth information signal that contains the selected ink identification information and a fourth command for requesting a transmission of individual tank information stored in the memory of the ink tank specified by the selected ink identification information to the ink controllers through the common wiring; and a fifth step of determining that a plurality ink tanks identified by the ink identification information are mounted in the mounting portion in the case where a response signal containing ink identification information and individual tank information is received from the controllers in response to the fourth command, and of determining that a plurality of ink tanks identified by the ink identification information are not mounted in the mounting portion in the case where a response signal is not received from the controllers in response to the fourth command.

In a third aspect of the present invention, there is provided an ink jet printer, comprising: a plurality of ink tanks, wherein each of the plurality of ink tanks has (i) a memory that stores at least (a) ink identification information for identifying a type of ink contained in the tank and (b) individual tank information of the ink tank, and (ii) a controller; amounting portion in which the plurality of ink tanks are detachably mounted; common wiring capable of electrically connecting in common with the tank control units of the plurality of ink tanks mounted in the mounting portion; and a controlling unit capable of executing a determination processing to (i) send a signal that contains a command and ink identification information for specifying the ink tank that should respond to the command, to the controllers through the common wiring, (ii) receive a response signal from one or more of the ink side control units in response to the command, wherein the response signal is the resulting signal received through the common wiring, and (iii) determine a state of mounting of the ink tanks in respect to the mounting portion based on information contained in the received response signal; wherein the controlling unit and the respective controllers of the plurality of ink tanks execute a first determination processing including: a first step wherein the controlling unit sends a first information signal that contains selected ink identification information and a first command for requesting a response as to whether or not the selected ink identification information and the ink identification information stored in the memory of the ink tank specified by the selected ink identification information, to the ink controllers through the common wiring; a second step wherein each of one or more controllers that stores, in its memory, the same ink identification information as the ink identification information contained in the first information signal, sends, in response to the first command, a response signal that expresses ink identification information agreement, to the controlling unit through the common wiring, and wherein each of the one or more controllers that does not store, in its memory, the same ink identification information as the ink identification information contained in the first information signal, does not send a response signal; a third step wherein the controlling unit determines that ink tank identified by the ink identification information is mounted in the mounting portion in the case where the controlling unit receives the response signal to the effect that there is agreement with the ink identification information, from the controllers in response to the first command, and determines that ink tank identified by the ink identification information is not mounted in the mounting portion in the case where the controlling unit does not receive the response signal to the effect that there is agreement with the ink identification information, from the controllers in response to the first command; and a fourth step wherein ink identification information corresponding to the plurality of ink tanks to be mounted are sequentially selected and the first to third steps are repeated; and wherein the controlling unit and the respective controllers of the plurality of ink tanks execute a second determination processing having: a fifth step wherein the controlling unit sends a second information signal that contains selected ink identification information and a second command for requesting a transmission of individual tank information stored in the memory of the ink tank specified by the ink identification information, to the ink controllers through the common wiring; a sixth step wherein each of the one or more controllers that stores, in its memory, the same ink identification information as the ink identification information contained in the second information signal, sends, in response to the second command, a response signal that contains the ink identification information and the individual tank information stored in its memory towards the controlling unit through the common wiring; a seventh step wherein the controlling unit sends a third information signal that contains (i) the selected ink identification information, (ii) the individual tank information contained in the response signal sent through the common wiring from the one or more controllers in response to the second command and (iii) a third command that requests a response as to whether or not the individual tank information contained in the response signal agrees with the individual tank information stored in the memory of the ink tank specified by the ink identification information, to the ink controllers through the common wiring; an eighth step that carries out an operation wherein each of the one or more controllers that stores, in its memory, the same ink identification information as the ink identification information contained in the third information signal, sends, in response to the third command, a response signal that contains the ink identification information and the individual tank information stored in its memory towards the controlling unit through the common wiring in the case where the individual tank information contained in the third information signal and the individual tank information stored in its memory agree, and does not send a response signal in the case where the individual tank information and the individual tank information stored in its memory do not agree; a ninth step wherein the controlling unit sends, when it has received the response signal through the common wiring from the one or more controllers in response to the third command, a fourth information signal that contains (i) the selected ink identification information, (ii) the individual tank information contained in the received response signal and (iii) a fourth command for turning the controller into a state wherein it can not send a response signal, to the ink controllers through the common wiring; a tenth step wherein, in response to the fourth command, the controller that stores in its memory ink identification information and individual tank information that are respectively the same as the ink identification information and individual tank information contained in the fourth information signal, turns itself into a state wherein it can not send a response signal; an eleventh step wherein, after the ninth step, the controlling unit sends a fifth information signal that contains the selected ink identification information and a fifth command for requesting a transmission of individual tank information stored in the memory of the ink tank specified by the selected ink identification information to the ink controllers through the common wiring; a twelfth step wherein a controller that stores, in its memory, the same ink identification information as the ink identification information contained in the fifth information signal, sends, in response to the fifth command, a response signal that contains the ink identification information and the individual tank information stored in its memory towards the controlling unit through the common wiring; a thirteenth step wherein the controlling unit determines that a plurality ink tanks identified by the ink identification information are mounted in the case where the controlling unit receives a response signal containing ink identification information and individual tank information from the controllers in response to the fifth command, and determines that a plurality of ink tanks identified by the ink identification information are not mounted in the case where the controlling unit does not receive a response signal from the controllers in response to the fifth command; and a fourteenth step wherein ink identification information corresponding to the plurality of ink tanks to be mounted are sequentially selected and the fifth to thirteenth steps are repeated.

In a fourth aspect of the present invention, there is provided an ink jet printer, comprising: a plurality of ink tanks, wherein each of the plurality of ink tanks has (i) a memory that stores at least (a) ink identification information for identifying a type of ink contained in the tank and (b) individual tank information of the ink tank, and (ii) a controller; amounting portion in which the plurality of ink tanks are detachably mounted; common wiring capable of electrically connecting in common with the tank control units of the plurality of ink tanks mounted in the mounting portion; and a controlling unit capable of executing a determination processing to (i) send a signal that contains a command and ink identification information for specifying the ink tank that should respond to the command, to the controllers through the common wiring, (ii) receive a response signal from one or more of the ink side control units in response to the command, wherein the response signal is the resulting signal received through the common wiring, and (ii) determine a state of mounting of the ink tanks in respect to the mounting portion based on information contained in the received response signal; wherein the controlling unit and the respective controllers of the plurality of ink tanks execute a first determination processing including: a first step wherein the controlling unit sends a first information signal that contains selected ink identification information and a first command for requesting a response as to whether or not the selected ink identification information and the ink identification information stored in the memory of the ink tank specified by the selected ink identification information, to the ink controllers through the common wiring; a second step wherein each of one or more controllers that stores, in its memory, the same ink identification information as the ink identification information contained in the first information signal, sends, in response to the first command, a response signal that expresses ink identification information agreement, to the controlling unit through the common wiring, and wherein each of one or more controllers that does not store, in its memory, the same ink identification information as the ink identification information contained in the first information signal, does not send a response signal; a third step wherein the controlling unit determines that ink tank identified by the ink identification information is mounted in the mounting portion in the case where the controlling unit receives the response signal to the effect that there is agreement with the ink identification information, from the controllers in response to the first command, and determines that ink tank identified by the ink identification information is not mounted in the mounting portion in the case where the controlling unit does not receive the response signal to the effect that there is agreement with the ink identification information, from the controllers in response to the first command; a fourth step wherein ink identification information corresponding to the plurality of ink tanks to be mounted are sequentially selected and the first to third steps 3 are repeated; and wherein the controlling unit and the respective controllers of the plurality of ink tanks execute a second determination processing having: a fifth step wherein the controlling unit sends a second information signal that contains selected ink identification information and a second command for requesting a transmission of individual tank information stored in the memories of the ink tanks specified by the ink identification information, to the ink controllers through the common wiring; a sixth step wherein each of the one or more controllers that stores, in its memory, the same ink identification information as the ink identification information contained in the second information signal, sends, in response to the second command, a response signal that contains the ink identification information and the individual tank information stored in its memory towards the controlling unit through the common wiring; a seventh step wherein the controlling unit sends a third information signal that contains (i) the selected ink identification information, (ii) the individual tank information contained in the response signal sent through the common wiring from the one or more controllers in response to the second command and (iii) a third command that requests a response as to whether or not the individual tank information contained in the response signal agrees with the individual tank information stored in the memories of the ink tanks specified by the ink identification information, to the ink controllers through the common wiring; an eighth step that carries out an operation wherein each of the one or more controllers that stores, in its memory, the same ink identification information as the ink identification information contained in the third information signal, sends, in response to the third command, a response signal that contains the ink identification information and the individual tank information stored in its memory towards the controlling unit through the common wiring in the case where the individual tank information contained in the third information signal and the individual tank information stored in its memory agree, and does not send a response signal in the case where the individual tank information and the individual tank information stored in its memory do not agree; a ninth step wherein the controlling unit sends, when it has received the response signal through the common wiring from the one or more controllers in response to the third command, a fourth information signal that contains (i) the selected ink identification information, (ii) the individual tank information contained in the received response signal and (iii) a fourth command for turning the controller into a state wherein it can not send a response signal, to the ink controllers through the common wiring; a tenth step wherein, in response to the fourth command, a controller that stores in its memory ink identification information and individual tank information that are respectively the same as the ink identification information and individual tank information contained in the fourth information signal, turns itself into a state wherein it can not send a response signal; an eleventh step wherein, after the ninth step, the controlling unit sends a fifth information signal that contains the selected ink identification information and a fifth command for requesting a transmission of individual tank information stored in the memory of the ink tank specified by the selected ink identification information to the ink controllers through the common wiring; a twelfth step wherein a controller that stores, in its memory, the same ink identification information as the ink identification information contained in the fifth information signal, sends, in response to the fifth command, a response signal that contains the ink identification information and the individual tank information stored in its memory towards the controlling unit through the common wiring; a thirteenth step wherein the controlling unit determines that a plurality ink tanks identified by the ink identification information are mounted in the case where the controlling unit receives a response signal containing ink identification information and individual tank information from the controllers in response to the fifth command, and determines that a plurality of ink tanks identified by the ink identification information are not mounted in the case where the controlling unit does not receive a response signal from the controllers in response to the fifth command; and a fourteenth step wherein the ink identification information of the ink tanks determined to be mounted at the first determination processing are sequentially selected and the fifth to thirteenth steps are repeated; and wherein the controlling unit executes a display processing that outputs a control signal such that an error indication concerning an ink tank that has been determined to be not mounted at the first determination processing and an error indication concerning an ink tank that has been determined to be mounted in plural at the second determination processing are performed differently.

According to the above configuration, it is possible to increase the accuracy of determining the mounting of multiple ink tanks, and in particular to increase the accuracy of determining whether or not multiple ink tanks of the same color are mounted. Furthermore, it enables the improvement of usability by making it possible to determine with high accuracy whether there is a multiple ink tank error or an error wherein an ink tank is not yet mounted, and to notify the user of that result.

Further features of the present invention will become apparent from the following description of exemplary embodiments with reference to the attached drawings.

BRIEF DESCRIPTION OF THE DRAWINGS

FIGS. 15A to 15C illustrate color ID tables formed by the main body side control circuit, which has received responses from the tank side control circuits;

DESCRIPTION OF THE EMBODIMENTS

Figure 1:
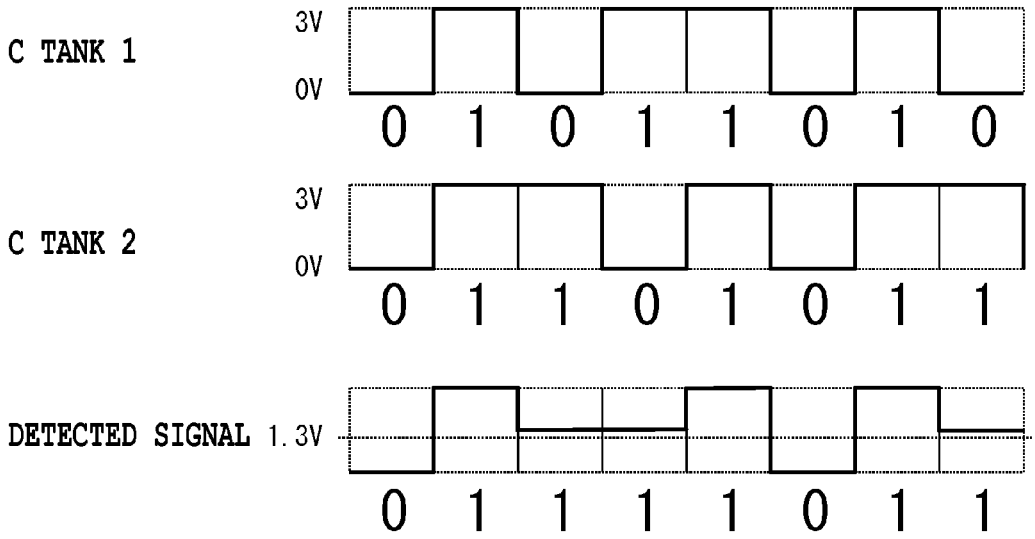
FIG. 1 is a waveform diagram showing, at the time when multiple ink tanks are mounted, the response waveforms sent by the respective tank side control circuits, and the collision waveform detected by the main body side control, circuit.

Embodiments of the present invention will be described in detail below while referring to the drawings.

<Printing Apparatus Main Body>

Figure 4:
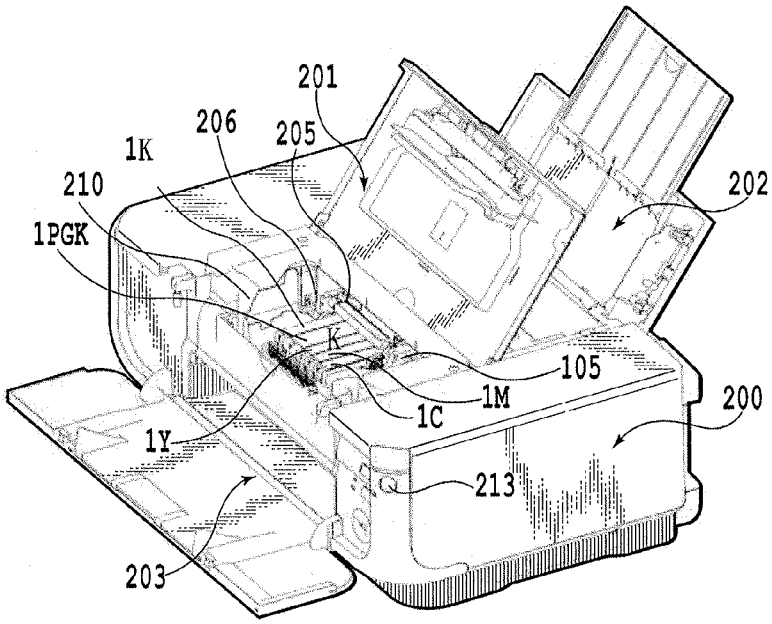
FIG. 4 is a perspective view that illustrates the ink jet printer of one embodiment of the present invention, with the main body cover 201, etc., in an opened state.

FIG. 4 is a perspective view that illustrates the ink jet printing apparatus of one embodiment of the present invention, with the main body cover 201, etc. open. The printer 200 of the present embodiment is provided with a printer main body in which the principal parts are concealed by the main body cover 201 and other parts of the case, and which has a structure wherein printing is carried out by a carriage, on which a print head and ink tanks are mounted, performing the motion necessary for scanning. A discharge tray 203 and an automatic sheet feeder (ASF) 202 are also provided respectively at the front and back of the printer main body. An operation panel 213 is furthermore provided, which has an electric switch, a reset switch and an indicator for indicating the state of the printer with respect to whether the main body cover is an open or closed position. The main body cover 201 is configured such that it capable of being opened and closed, and conceals the carriage 205 across its range of movement. In a state where the main body cover 201 is open, as shown in FIG. 4, a user is able to view the range and surrounding vicinity in which the carriage, mounted with a print head unit 105 and a plurality of detachable ink tanks, moves. More concretely, when the main body cover 201 is opened, a sequence is executed wherein the carriage 205 automatically moves to the approximately centered position shown in the figure (also hereinafter referred to as the "tank exchange position"), and at this tank exchange position the user can perform a replacement operation to replace the respective ink tanks.

In the present embodiment the plurality of ink tanks comprise ink tanks 1K, 1PGK, 1Y, 1M and 1C, which respectively store dye-based black ink (K), pigment-based black ink (PGK) yellow ink (Y), magenta ink (M), and cyan ink (C). Chip-type print heads (not shown), corresponding to each of the above ink colors, are provided on the print head unit 105, scan a print medium such as paper via the back and forth movement of the carriage 205, and perform printing by ejecting ink onto the print medium during these scans. That is, the carriage 205 is slidably engaged to the guide axis that extends along its direction of movement, and the back and forth motion described above can be carried out via a carriage motor and its driving force transmission mechanism. It should be noted that in the present embodiment the mounts for each of the ink tanks 1K, 1PGK, 1Y, 1N and 1C are aligned in one direction, and that the back and forth movement of the carriage 205 is in this same direction of alignment. Thus the ejection of ink is carried out at the respective print heads corresponding to each of the ink colors, based on ejection data sent from the main side control circuit through the flexible cable 206. Conveyance mechanisms such as a conveyance roller and a discharge roller are also provided and the print medium (not shown) fed from the automatic sheet feeder 202 can be discharged into the discharge tray 203.

As for the printing operation, the print heads scan the print medium by way of the above described motion, during which ink is ejected onto the print medium from the respective print heads, and it is possible to carry out the printing of an area with a width that corresponds to the range of the nozzles aligned on the print head. Printing is herewith carried out sequentially on the print medium by way of the aforementioned conveying mechanism conveying, between scans, the print medium a prescribed distance that corresponds to the aforementioned width. A recovery unit (not shown), such as a cap that covers the surfaces where the nozzles of each of the print heads are arranged, is provided at the end of the area in which the print head moves via the movement of the aforementioned carriage. Herewith the print head moves to the location where the recovery unit is provided for a prescribed period of time, and a recovery operation, such as a preliminary ejection or a suction-based recovery, is performed.

Figure 6:
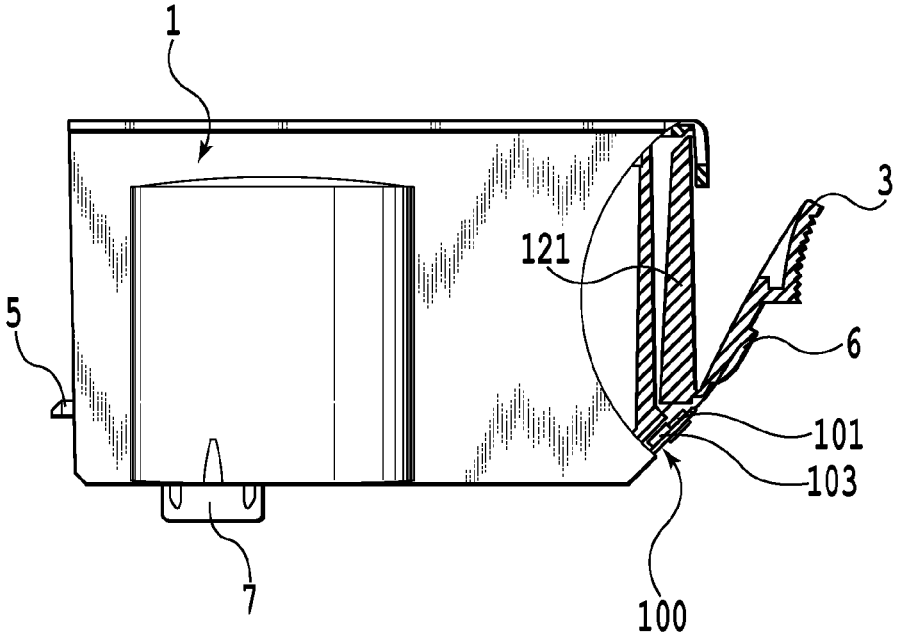
FIG. 6 is a view illustrating the structure of an ink tank used in the aforementioned ink jet printer.

A light reception unit 210 having a light receiving element is provided in the vicinity of the end of the side opposite the location where the aforementioned recovery unit is provided, within the range of movement of the carriage 205. The light reception unit 210 is, for example, a phototransistor but may be another type of light receiving element. The light reception unit 210 is arranged laterally to the movement path of the carriage 205. Herewith the relative positional relationship of the light reception unit 210 and each of the aforementioned plurality of mounts changes, and the light reception unit 210 can become opposite (face) each of the mounts via movement of the carriage 205. Thus, as described hereinafter, light from the light emitting units 101 provided on each of the ink tanks is received by the light reception unit 210, and based on the light reception outcome it is possible to carry out a determination (an optical checking processing) as to whether the ink tanks are mounted at the correct position or not. The present embodiment has a configuration wherein the light emitting units 101 directly project light onto the light reception unit 210, however, as shown in FIG. 6, it may also have a configuration wherein a light guidance element or the like is interposed and light is indirectly projected onto the light reception unit 210.

<Ink Tank Mounting Unit>

Figure 5B:
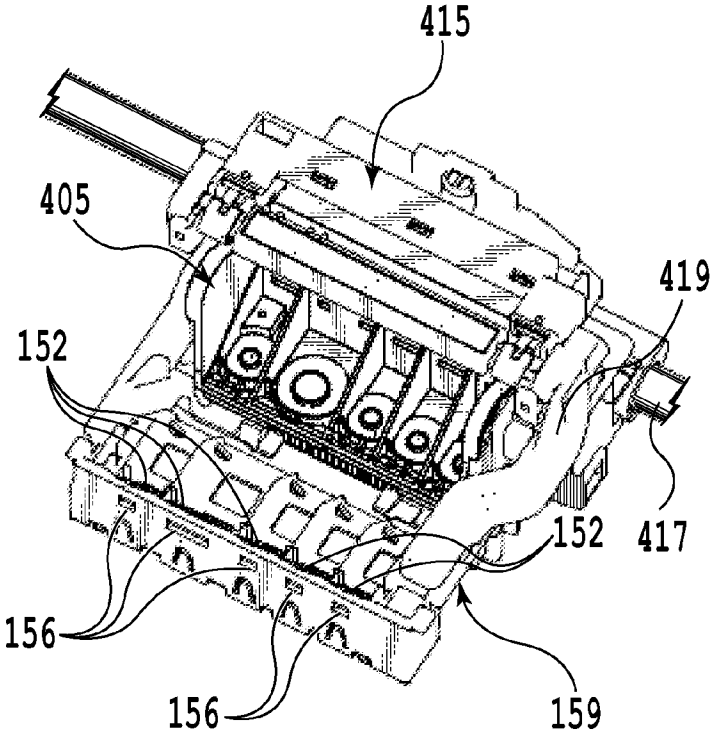
FIGS. 5A and 5B are perspective views illustrating an exemplary structure of the ink tank mounting unit of the aforementioned ink jet printer.
Figure 5A:
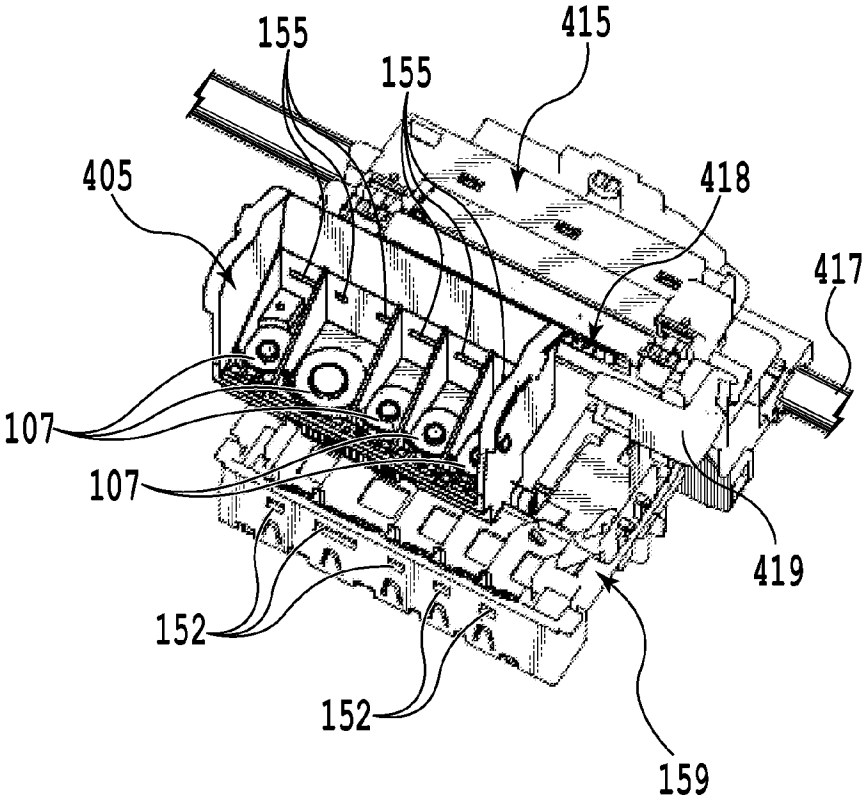

FIGS. 5A and 5B illustrate the ink tank mounting unit (also referred to as a tank holder) on the carriage 205 (415) of the aforementioned printer. FIG. 5A is a perspective view that illustrates a state where the print head unit, which receives a supply of ink from the ink tanks and executes a printing operation, is separated apart, and FIG. 5B is a perspective view that illustrates a state wherein the print head unit is mounted. The print head unit 405, as shown in FIG. 5A, is provided at its bottom surface with ink introduction conduits 107 that connect to the ink supply ports of the ink tanks, with first locking units 155 at its rear side, and with electrical contacts (not shown) on its reverse side for signal transmission. On the other hand, as shown by FIGS. 5A and 5B, a lever 419 for mounting and fixing the print head unit 405, and electrical contacts 418 that connect to the print head side electrical contacts, are provided on the carriage 915 (corresponding to carriage 205 of FIG. 4, which is capable of moving along the shaft 417. Holder portions that correspond to the front sides of the ink tanks 1 are also provided on the carriage main body 415. Furthermore, second locking units 156, connectors 152 that serve as electrical contacts, and a wiring portion 159 are provided on the sides of the carriage. In a state where the print head unit 405 is mounted, as shown in FIG. 5B, the entire body of the ink tank mounting unit (mounting portion) is framed within the carriage 415. That is, mounts for each of the K, PGK, Y, M and C ink tanks are configured in order from the left of the same figure. Connection of the ink supply ports of the ink tanks to the ink introduction tubes of the ink tank mounts, as well as connection of the electrical contacts of the ink tanks (the electrical pads 102 shown in FIG. 7A) to the electrical contacts of the ink tank mounts (the connector 152), takes place at these mounts, and the mounting processing is thereby completed.

<Ink Tank>

FIG. 6 is a view that illustrates the structure of an ink tank used in the aforementioned printer. In FIG. 6, the ink tank 1 has a support member 3 (a latch lever) that is supported at the bottom portion. The support member 3 is integrally formed, out of resin, to the exterior of the ink tank, and has a structure capable of deforming elastically around a bearing member upon performing amounting operation of the aforementioned tank holder. A first engaging member 5 and a second engaging member 6 (in the present example, the second engaging member is integrated with the support member 3), which are respectively capable of engaging the aforementioned first locking unit 155 and second locking unit 156 provided on the ink tank mount shown in FIG. 5, are provided on the ink tank 1. When an ink tank is mounted in a tank holder, the ink tank is first placed in the tank holder such that the first engaging portion 5 and the first locking unit 155 become engaged. At this point in time the electrical contacts of the ink tank (the electrical pads 102 of FIG. 7A and the electrical contacts of the tank holder (the connectors 152) are not in contact with each other. Next, the front face of the ink tank placed in the tank holder is pressed down. Herewith the ink tank rotates about the portion where the first engaging portion 5 and the first locking unit 155 engage, and the second engaging portion 6 and the second locking unit 156 become engaged. Mounting of the ink tank 1 in the ink tank mount (tank holder) is thus completed by this engagement. In this state where mounting has been completed, an electrical connection between the ink tank and the apparatus main body is ensured as the electrical contacts of the ink tank and the electrical contacts of the tank holder are in contact. An ink supply port 7, which contacts the ink introduction tube 107 when mounted in the tank holder and is for carrying out the supply of ink, is provided on the bottom surface of the ink tank 1. A substrate is provided at the portion (in this example, a slanted surface) where the bottom surface and front surface connect. The shape of the substrate may be tip-shaped or plate-shaped but will be described hereinafter as substrate 100. A light guidance member 121, which guides light emitted from the light emitting unit 101 provided on the substrate 100, is provided on the surface of the side on which the support member 3 of the ink tank 1 is provided.

Figure 7B:
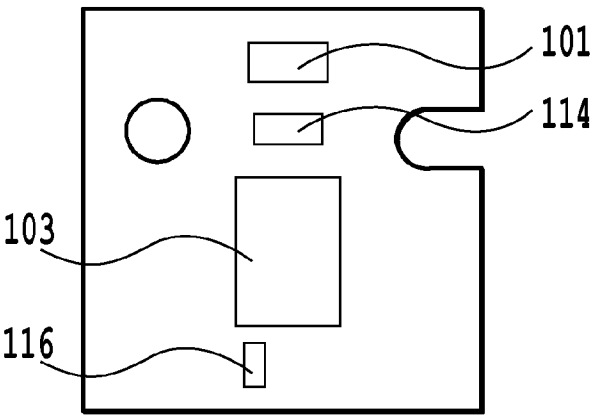
FIGS. 7A and 7B are diagrams that illustrate an example of the control substrate respectively mounted on the aforementioned ink tanks.
Figure 7A:
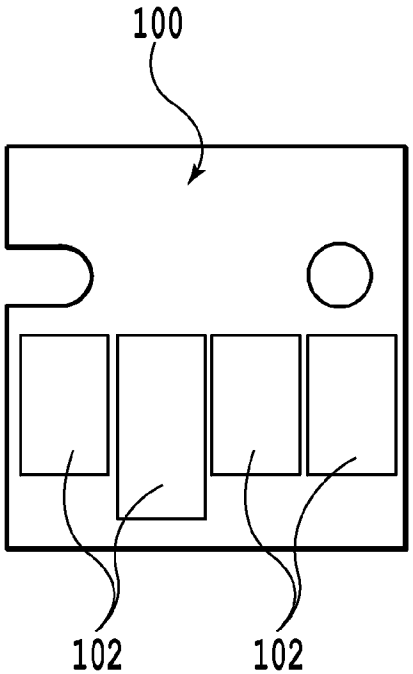

FIGS. 7A and 7B are diagrams that explain the structure of the substrate 100 provided on the ink tank, and illustrate the front side and reverse side of the substrate, respectively. When an ink tank is mounted in the tank holder the connectors 152, serving as apparatus main body side electrical contacts, and the electrode pads 102 (FIG. 7A), serving as tank side electrical contacts on the substrate 100 of the ink tank 1, contact, and an electrical connection becomes possible. Data (information) transfer between the ink tanks and the apparatus main body thus becomes possible due to this electrical connection. A light emitting unit 101 and a control circuit 103 (also referred to as a control portion or a control unit), for controlling the light emitting unit, is provided on the reverse face of the surface on which the electrode pads 102 are provided. The control circuit 103, serving as a tank side controlling portion (also referred to herein as "controller"), carries out light emitting and extinction at the light emitting unit 101, in accordance with electric signals supplied via the connectors 152 and electric pads 102. The limiting resistor 114 is a resistor for limiting electric current input into the light emitting unit 101, and is included in the case where a LED is used as the light emitting unit. The condenser 116 is for stabilizing voltage applied to the control circuit 103. It should be noted that FIG. 7A illustrates a state wherein the control circuit 103 that has been previously packaged by resin or the like mounted on the substrate 100. Also, in the case where a memory, which records information such as ink identification information (for example, color ID) for identifying the type of ink stored in an ink tank (for example, color, type of color material, concentration of contained color material, etc.) and ink amount information (the amount of used ink and remaining ink), is mounted on the substrate 100, it may also be mounted inside of the package in advance.

<Structure of the Contact Portion>

Figure 8:
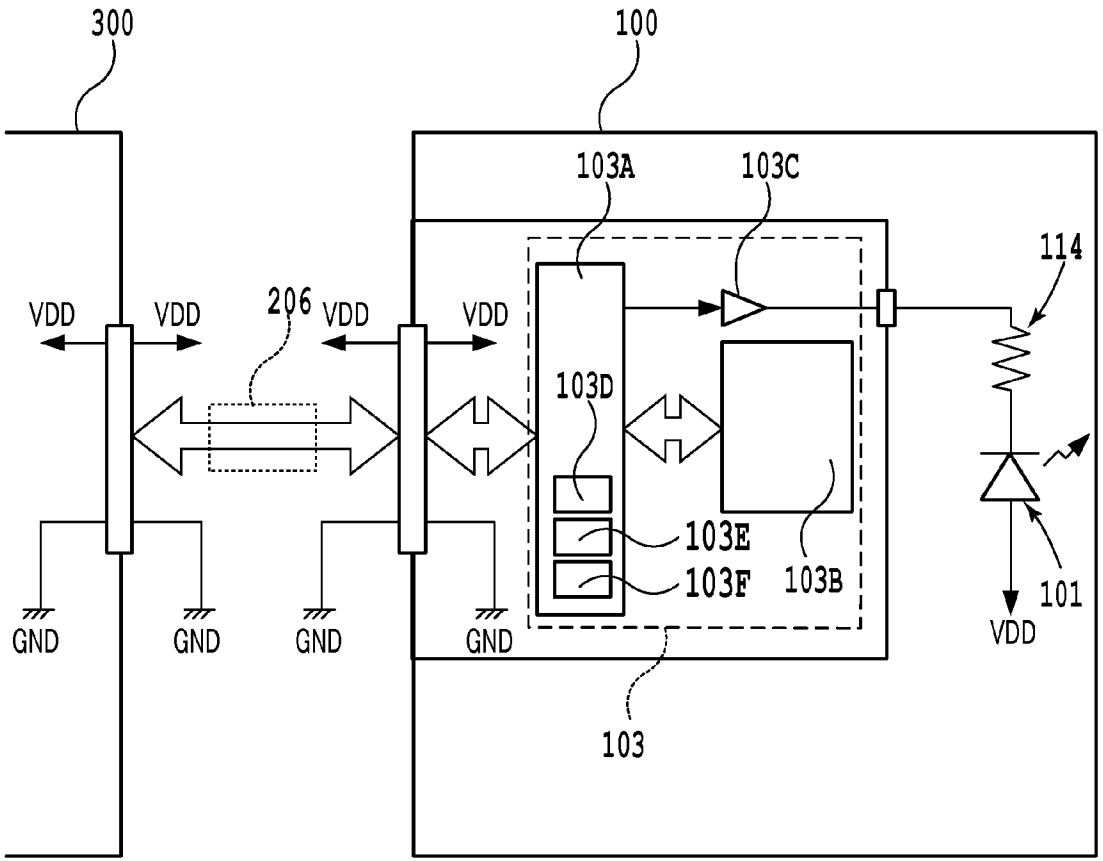
FIG. 8 is a circuit diagram that illustrates the details of the substrate 100 on which the control circuits of the aforementioned ink tanks are provided.

FIG. 8 is a circuit diagram that illustrates the details of the substrate 100 on which the control circuit (control unit, control means) 103, etc. are provided. As shown in the figure, the control circuit 103 is configured to have an input-output control circuit (I/O CTRL) 103A, a memory 103B and a LED driver 103C. The input-output control circuit 103A serves as a drive control unit that carries out drive control of the light emitting unit 101 through the LED driver 103C, according to control data (control signals) sent from the main body side control circuit 300 via the flexible cable 206 serving as a common wiring. The input-output control circuit 103A also controls the writing of data onto the memory 103B and the readout of data from the memory 103B. The control circuit 103 has a buffer unit 103D for receiving control signals (control data) sent from the main body side control circuit 300 and has a command determination unit (not shown) that identifies designated commands and serves to determine whether the color ID and individual tank number (individual tank number information) included in the sent control signal (control data) agree with the aforementioned color data and individual tank number stored within the control circuit itself. Furthermore, the control circuit 103 has a register 103E for temporarily storing data and a clock-counter 103F for counting the input clock number.

In the present embodiment the memory 103B takes the form of an EEPROM but it may also be another type of memory device. The memory 103B serves as a memory unit and it can store information specific to ink tank 1. The aforementioned ink identification information (for example, color ID), individual tank number information, as well as manufacturing information that denotes, for example, the ink tank production date or production lot number, are raised, for example, as kinds of information that may be the tank specific information. As stated above, in the present embodiment, ink identification information and individual tank number information, which are tank specific information, serve as identification information that identifies the ink tank. It should be noted that the ink identification information is written at a prescribed address of the memory 103B at the time of ink tank shipping or manufacture, according to the type of ink stored in the tank (for example, color, type of color material, concentration of contained color material).

Information that denotes the remaining amount of ink in a tank or the amount of ink consumed, for example, can be listed as information that can be written and read out from the memory 103B. The method of writing information to the memory 103B and reading out information from the memory 103B will be described later while making use of FIG. 11. The control circuit 300 of the present embodiment counts the number of ejections of each print head based on image printing ink ejection data and thereby calculates the amount of consumed ink, calculates the amount of ink discharged in connection with the suction-based recovery operation by the recovery unit, and based on the results of these computations is capable of calculating the amount of ink remaining and consumed, for each ink tank. Next, making use of data transfer between the main body side control circuit 303 and the tank side control circuit 103, an operation is performed wherein the remaining ink amount information and consumed ink amount information are written into the memory 103B of the corresponding ink tank, and an operation is performed wherein the ink amount information is read out from the memory 103.

The LED driver 103C operates such that voltage is applied to the light emitting unit 101 when the signal input from the input-output control circuit 103A is OFF, and therewith causes the light emitting unit 101 to emit light. On the other hand, The LED driver 103C operates such that voltage is not applied to the light emitting unit 101 when the signal input from the input-output control circuit 103A is ON, and therewith causes the light emitting unit 101 to cease emitting light. Thus, when the signal input from the input-output control circuit 103A is in the OFF state, the light emitting unit 101 remains in a lit state and when the above signal is in the ON state the light emitting unit 101 remains in an unlit state. A terminal for connecting the anode side of the light emitting unit 101 to the driver 103C and a terminal for connecting the cathode side of the light emitting unit 101 to the ground line are provided. 114 denotes a limiting resistor for dictating the current that passes into the light emitting unit 101, and this limiting resistor 114 is inserted between the output of the LED driver 103C and the anode of the LED 101. Herein, power is supplied from a VOID power supply pattern provided on the inner portion of the substrate 100 of the ink tank. The control circuit 103 is generally assembled and formed onto a semiconductor substrate and has a structure wherein the contact terminal on this semiconductor substrate is a LED connection terminal only.

<Control System Configuration>

Figure 9:
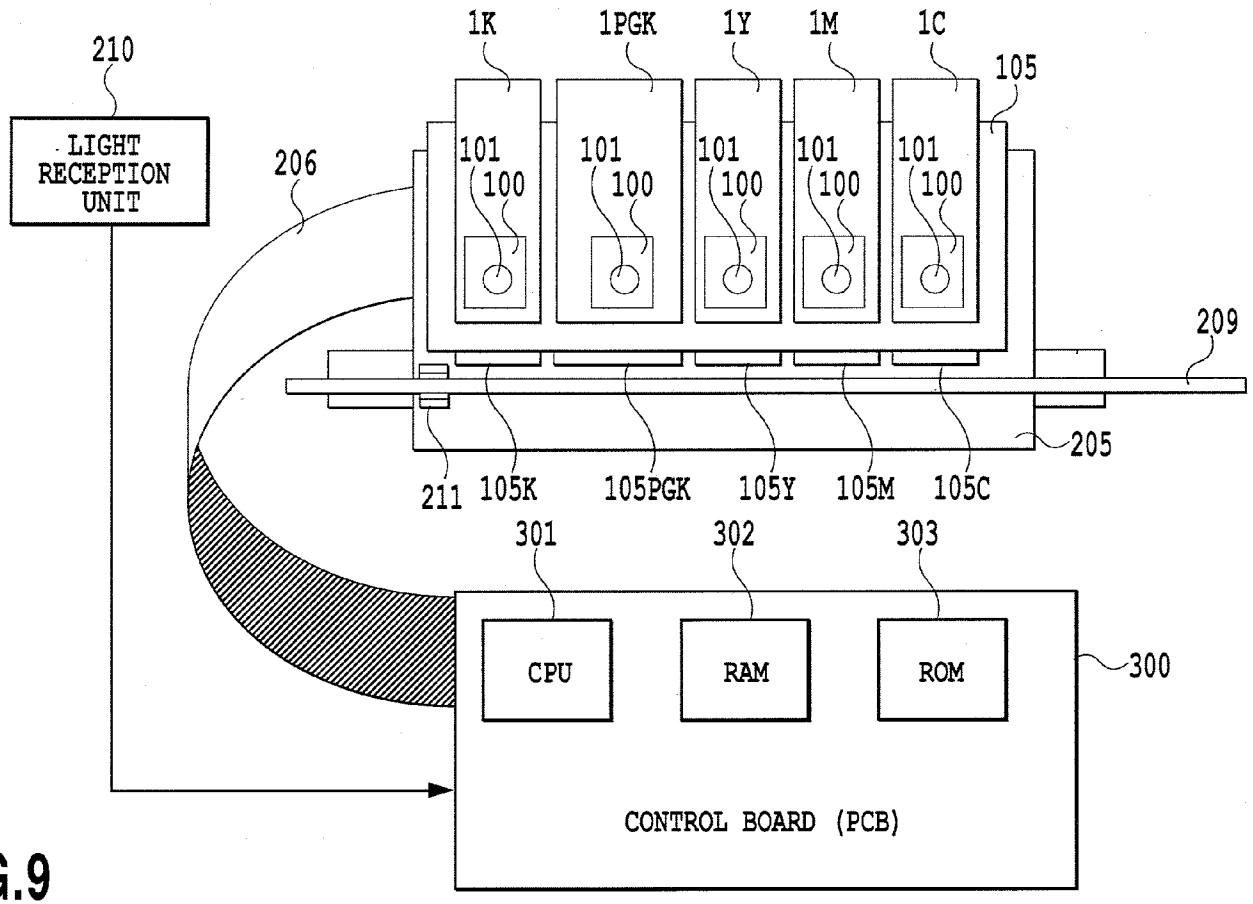
FIG. 9 is a block diagram that illustrates the control structure of the aforementioned ink jet printer.

FIG. 9 is a block diagram that illustrates the control system configuration of the aforementioned ink jet printer. FIG. 9 mainly illustrates a control circuit 300 serving as a PCB (Printed Circuit Board) type main body side control unit provided on the printer main body, the control circuits 103 controlled thereby and provided on the ink tanks, and the structure relating to the light emitting of the light emitting units 101.

In FIG. 9, the control circuit 300 executes data processing and operation control relating to the ink jet printer of the present embodiment. More specifically, the CPU 301 executes the operations to be later described at FIG. 12 in accordance with programs stored in the ROM 303. The RAM 302 is used as a work area when processing is executed by the CPU 301.

On the other hand, print heads 105K, 105PGK, 105Y, 105M and 105C, on which a plurality of ejection ports are respectively formed for ejecting K, PGK, Y, M and C ink, are provided on the print head unit 105 of the carriage 205. The ink tanks 1K, 1PGK, 1Y, 1M and 1C, which correspond to these print heads, may be detachably loaded into the holders of the print head unit 105. As described above, light emitting units 101, control circuits 103 and a substrate 100 on which pads 102 that are contact terminals, and the like are provided, are attached to each of the ink tanks. When an ink tank is properly mounted in a holder of the print head unit, the pads 102 on the aforementioned substrate 100 contact the connector 152 provided on the holder of the print head unit 105. Furthermore, the connector (not shown) provided on the carriage 205 and the aforementioned connector 152 provided on the print head unit 105 electrically connect via the mounting of the print head unit 105 on the carriage 205. The connector (not shown) provided on the carriage 205 and the main body side control circuit 300 also electrically connect, via the flexible cable 206. The main body side control circuit 300 and the control circuits 103 of each of the ink tanks electrically connect and the transmission and reception of signals therebetween is made possible via the above connection structure. Herewith, the control circuit 103 serving as a tank control unit and the control circuit 300 serving as a main body side controlling portion (also referred to herein as "controlling unit") are capable of carrying out control of the later described mount checking processing, optical checking processing, and the like. That is, the main body side control circuit enables the execution of a determination process for determining the mounting state of ink tanks in relation to the mounting portions.

Control of ink ejection at each of the print heads 105K, 105PGK, 105Y, 105M and 105C is similarly performed. That is, the drive circuits, and the like, provided on each of the print heads are electrically connected to the main body side control circuit 300 via the flexible cable 206, the connectors of the carriage 205 and the connectors 152 of the print head unit. Herewith the control circuit 300 is capable of controlling the ejection of ink, and the like, at the respective print heads.

The light reception unit 210, which is provided in the vicinity of one end of the range in which the carriage 205 moves, receives light emitted from the light emitting unit 101 of an ink tank 1, and inputs a signal, which is in accordance therein, to the control circuit 300. As to be described later, the control circuit 300, based on this signal, is capable of determining whether or not the correct ink tank is mounted in the correct mount of the carriage 205 (optical checking processing). An encoder scale 209 is also provided along the movement path of the carriage 205, and a encoder sensor 211 is provided on the carriage 205. The detected signal of this sensor is input into the control circuit 300 via the flexible cable 206, and the control circuit 300 detects the mobile position of the carriage 205 according to the input detection signal. This mobile position information is used in controlling ejection at each of the print heads, and it is also used in establishing the timing of light emission and light reception during the optical checking process that determines whether or not the mounted position of an ink tank is correct.

Figure 10:
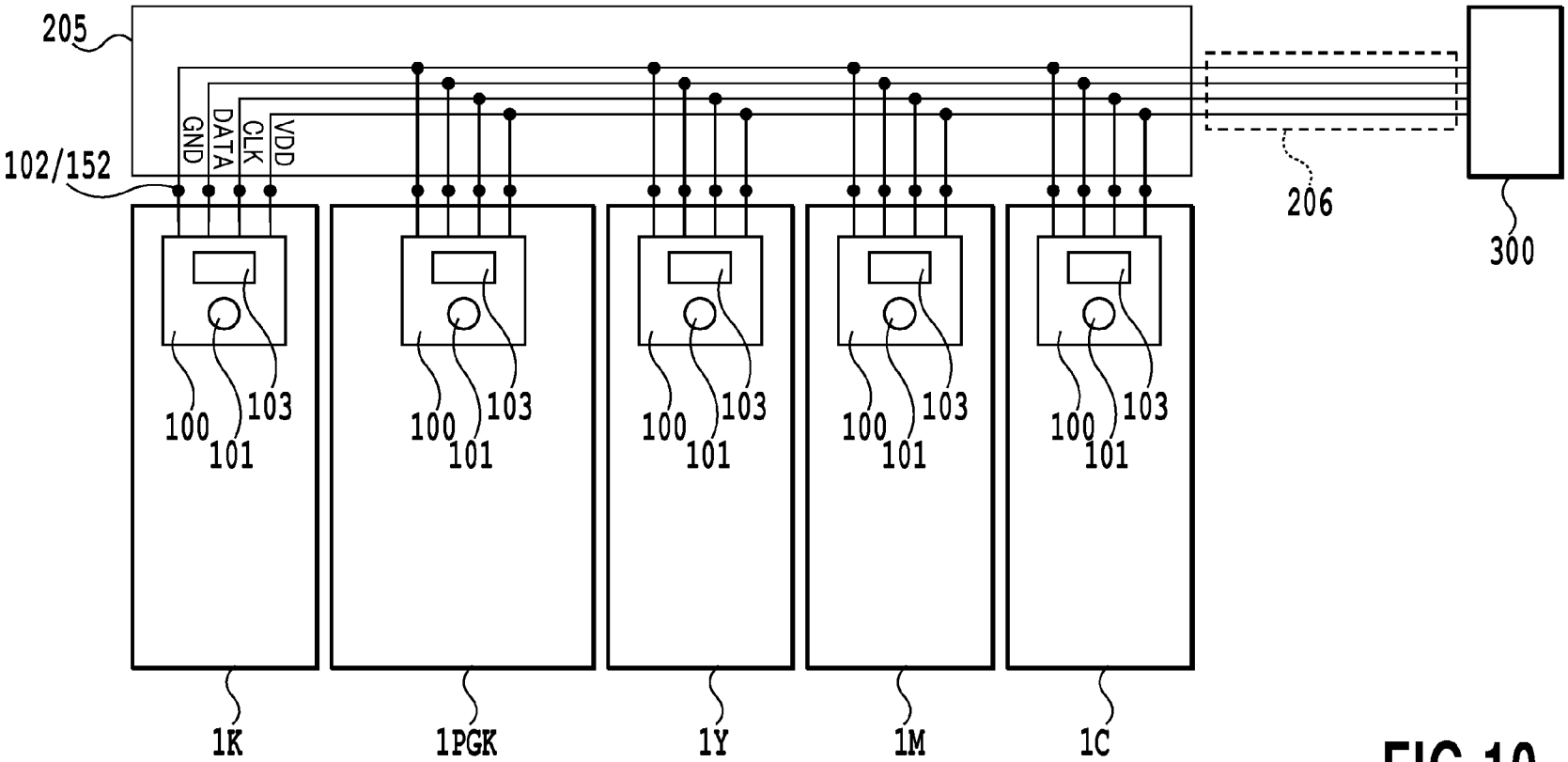
FIG. 10 is a diagram that illustrates the configuration of the signal line for signal connection between the control circuit of the aforementioned ink jet printer and the ink tanks.

FIG. 10 is a diagram that shows the arrangement of the signal wiring between the main body side control circuit 300 described above at FIG. 9 and the tank side control circuits 103, in respect to its relationship to the substrate 100 of each ink tank. As shown by FIG. 10, the signal wiring, corresponding to each of the ink tanks, is comprised of 4 signal lines, and is a signal wiring that enables the common connection of the five ink tanks (a so-called bus connection wiring). That is, the signal wiring corresponding to the respective ink tanks is comprised of four signal lines: a power supply signal line [VDD], an earth signal line [GND], a data signal line [DATA] and a clock signal line [CLK]. The power supply signal line [VDD] is a wire for supplying electric power necessary for operation of the control circuits 103, which control circuits 103 carry out, for example, control of light emitting by the light emitting units 101 on the ink tanks and color ID and individual tank number comparisons, and for supplying electric power necessary for the performance of light emitting by the light emitting units 101. The data signal line [DATA] is a signal line for transmitting, from the control circuit 300 to the control circuits 103, control signals in connection with color ID and individual tank number return requests, control signals in connection with the control of light emission and extinction by the light emitting unit 101, control signals in connection with control of the writing to and reading from the memories 103B, and the like, and for transmitting color ID, individual tank number, and the like from the control circuits 103 to the control circuit 300. The present embodiment is explained by way of 4 signal lines but it should be noted that the present invention is not limited as such; for example it is also possible to omit the [GND] line by way of implementing the earth signal in another structure. It is also possible to configure the [CLK] and [DATA] signal lines such that they share a common wiring. The control circuits 103 and the light emitting units 101 on the substrates 100 of the respective ink tanks operate according to signals of the four signal lines.

Figure 11:
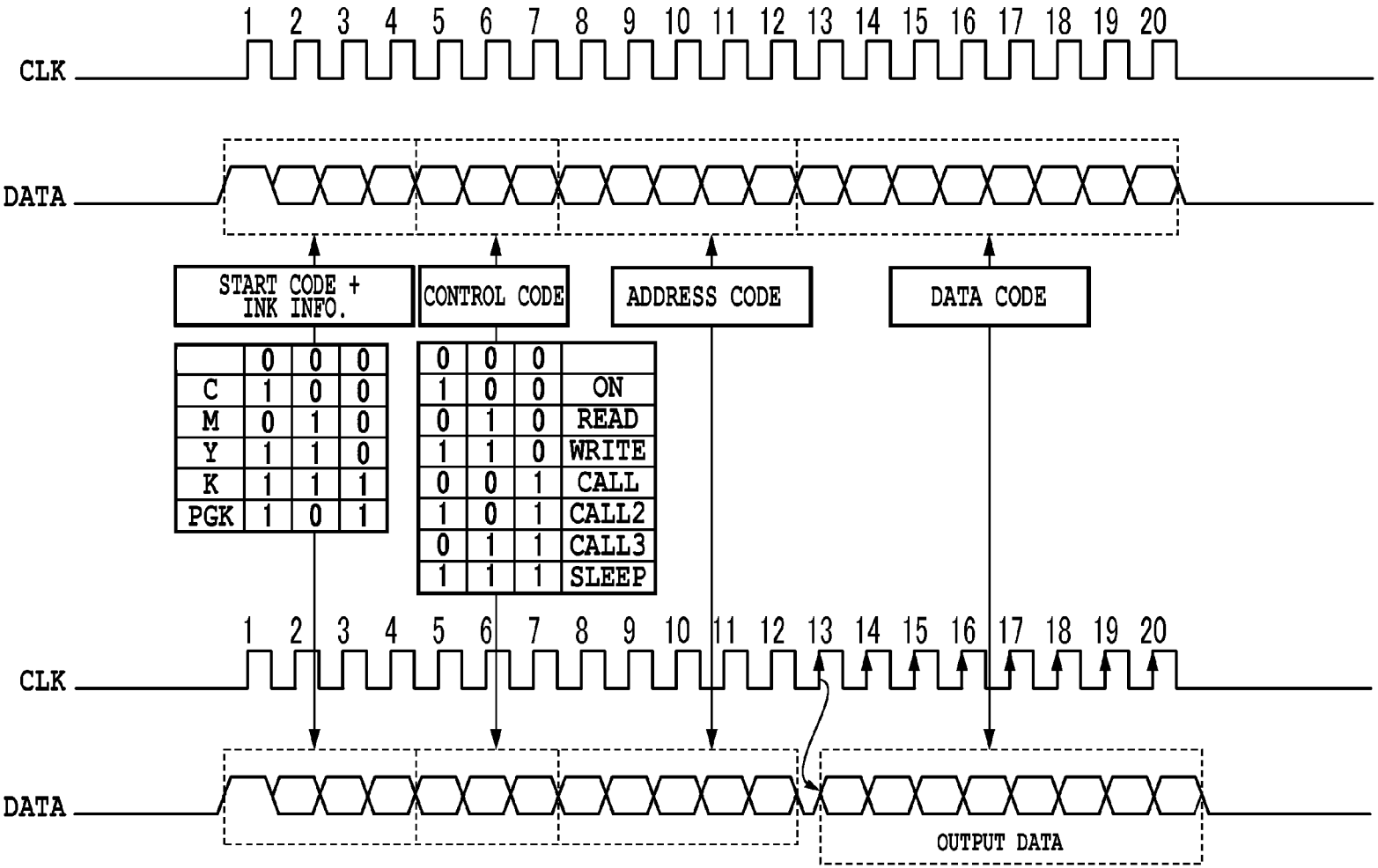
FIG. 11 is a diagram mainly for explaining the control signals sent from the main body side control circuit of the aforementioned ink jet printer to the control circuits of the respective ink tanks.

FIG. 11 is a diagrammainly for explaining the control signals (control data) sent from the main body side control circuit 300 to the control circuits 103 of the respective ink tanks. A "control code", which carries out the command function, is included in a control signal. As to be described later, as control codes (commands), there are, for example, [WRITE] codes (write commands) that order the writing of data onto the memory 103B of the control circuit 103, [CALL] codes (identification information return request commands) for requesting ink tank ink identification information (also referred to hereafter as "color ID"), and [CALL2] codes (individual tank number information return request commands) for requesting the individual tank number of an ink tank. When control signals containing these commands (control codes) are sent to the tank side control circuits 103, because color ID is included in the control signals, the ink tanks that should be subject to responding to the commands can be specified, via the color ID.

With respect to writing onto the memory 103B, a control signal (control data) consisting of a data array comprising

[start code+color ID], [control code (command)], [address code] and [data code], is synchronized with the clock signal CLK and sent in this order from the main body side control circuit 300 to the input-output control circuit 103A of the tank side control circuit 103 via the DATA signal line (FIG. 10). [Start code+color ID] means starting a chain data signal via the [start code] signal, and the specification, by the [color ID] signal, of the ink tanks that are subject to this chain data signal. As shown in the figure, [color ID] has a code corresponding to ink types [K], [PGK], [C], [M] and [Y], and the input-output control circuit 103A compares the color ID denoted by this code to its own color ID stored in the memory 103B, performs an operation in accordance with the subsequent control code only when the color IDs match, and does not perform an operation in accordance with the subsequent control code when the color IDs do not match. Herewith, even though a control signal is commonly sent from the main body side control circuit 300 to the respective ink tanks, via the common data line [DATA] shown in FIG. 10, it is possible that only the ink tanks specified by the color ID perform an operation according to the subsequent control command. Here, it should be clear from the above explanation that a structure using this type of common data signal line can be made the same regardless of the number of ink tanks.

As shown by FIG. 11, included in the control code are an [ON] code (light-on command) used in controlling the lighting of the light emitting unit 101 or an [OFF] code (light-off command) used in controlling the extinction of light at the light emitting unit 101, which codes relate to the later described optical checking processing. A [READ] code (readout command) that prompts readout from the memory 103B and a [WRITE] code (write command) that prompts writing onto the memory 103E are also included.

Further included in the control code are a [CALL] code (color ID return request command) for requesting the color ID of an ink tank, a [CALL2] code (individual tank number information return request command) for requesting the individual tank number of the ink tank, which is described later, and a [CALL3] code (agreement response request command) for, in the case where individual tank numbers agree with each other, requesting a response to that effect. Furthermore, with respect to embodiments of the present invention, a [SLEEP] code is included, which is used in a later described process for determining whether multiple ink tanks having the same color ID are mounted. The [SLEEP] code is a command that forces the tank side control circuit 103 into a sleep state, that is, a state of non-response (a state where it does not respond to control signals from the main body side control circuit).

It should be clear that the contents expressed by the "command code" are not limited to above example; for example, control commands may also be added that relate, for example, to verification commands or continuous readout commands.

For example, with respect to writing, based on an [ADDRESS] code following the [WRITE] code, the memory address that is the location to be written to is designated and the final [DATA CODE] becomes the written content. As written content there are, for example, ink amount information and the like. With respect to readout, the structure of control signals is the same as in the case of writing as described above, and the output of readout data is performed in synchronization with the rising edge of the first clock (the 13th clock in FIG. 11) after the address has been designated by the address code.

The [CALL] code, for example, is used in an ink tank removal and mounting process later described at FIG. 12. The input-output control circuit 103A, which has received the [CALL] code, checks whether there is agreement between the color ID included in the sent control signal and its own color ID stored in memory 1038. When the agreement has been confirmed, the control circuit 1038 sends its own color ID to the main body side control circuit 300, as a response to the effect that there is agreement. On the other hand, when agreement can not be confirmed, the control circuit 103B does not send a response to the control circuit 300. Thereby, for example, in a case that the color ID corresponds to cyan ink C, the control circuit 300 is capable of checking whether or not a cyan ink tank has been mounted. In other words, [CALL1] is a command that requests an ink identification information (color ID) response.

The [CALL2] code is used in the mount checking process later described at FIGS. 14A, 14B, 16A and 16B. More specifically, the control circuits 103B of the ink tank that receives a [CALL2] code and has the color ID agreement reads out its own individual tank number stored in memory 103B and sends the read out individual tank number, along with the color ID, to the control circuit 300. In other words, [CALL2] is a command that requests an individual tank number response.

Also, with respect to the mount checking processing, as described later, the main body side control circuit 300 sends the color ID of the ink tank(s) that responded with an individual tank number in response to the aforementioned [CALL2] code and the responded individual tank number to the ink tanks via a [CALL3] code, and performs a processing that checks whether there is individual tank number agreement. Then, the control circuits 103B of the ink tank that receives the [CALL3] code and has an agreement of color Ids determines whether or not there is agreement between its own individual tank number stored in memory 103B and the arrived individual tank number sent as a data code along with the [CALL3] code. When there is agreement a specific ID, as a response to the effect that there is agreement, along with a color ID, is sent to the control circuits 300, and no response is made where there is no agreement. In other words, [CALL3] is a command that requests, in the case where there is agreement between individual tank numbers, a response to that effect.

<Control Process>

Figure 12:
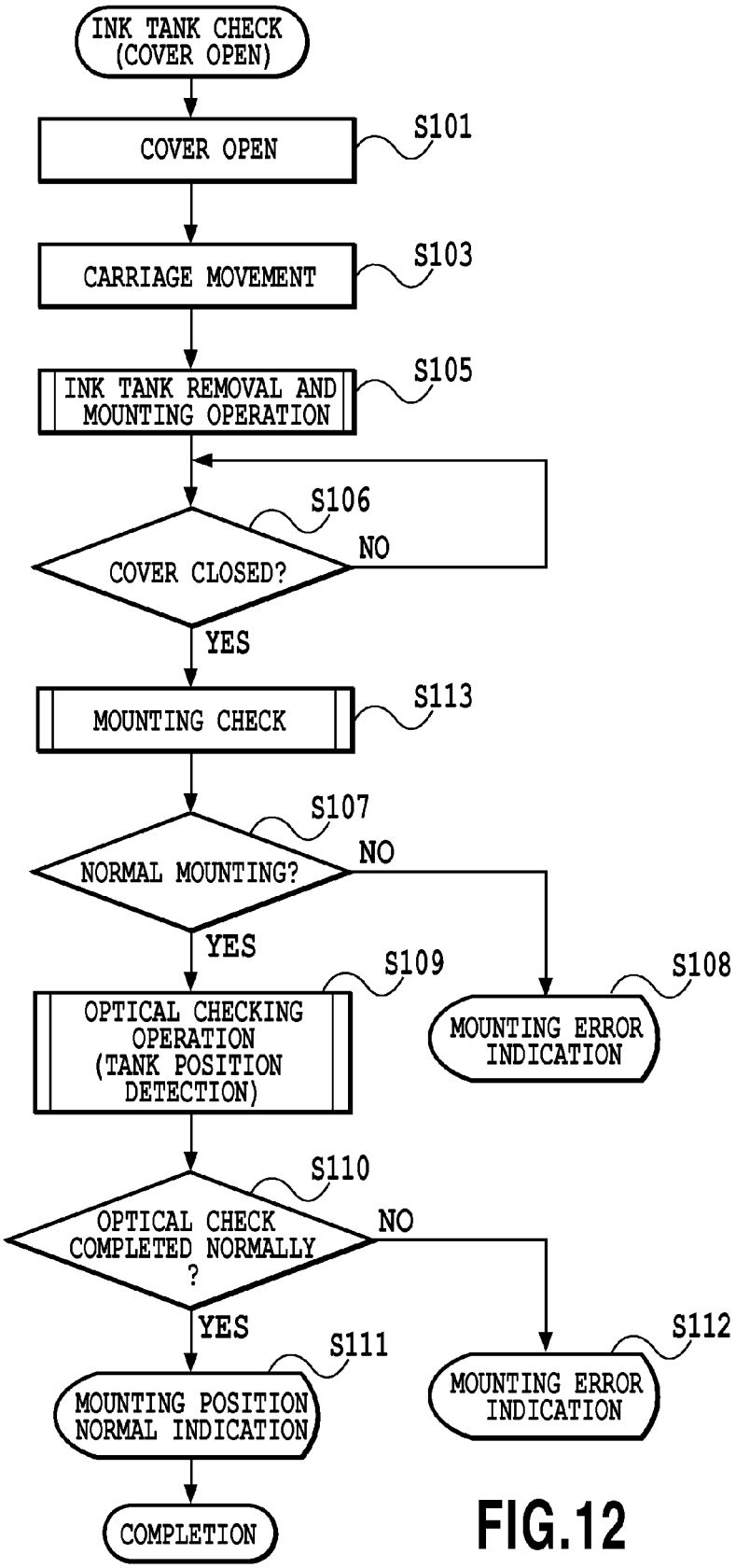
FIG. 12 is a flow chart that illustrates a process in connection with ink tank mounting when ink tanks of one embodiment of the present invention are exchanged.

FIG. 12 is a flow chart that illustrates a process in connection with the ink tank mounting when ink tanks are exchanged, according to one embodiment of the present invention.

When the main body cover 201 is opened by a user, a sensor (not shown), which is provided on the apparatus main body and detects the open or closed state of the main body cover 201, detects that the cover is open (step S101). When it has been detected that the cover is open, at step S103 movement of the carriage, to the "tank exchange position" set in the vicinity of the center of the region in which the carriage moves, is commenced, and at step S105 an ink tank removal and mounting processing is performed.

Figure 13:
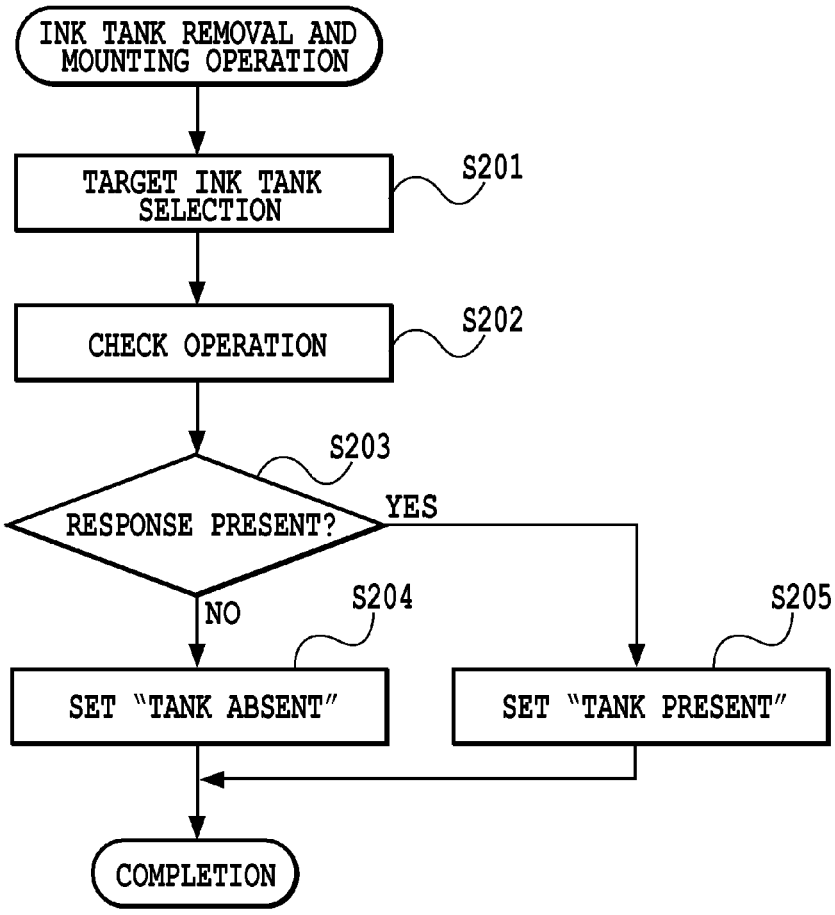
FIG. 13 is a flow chart that illustrates details of the ink tank removal and mounting processing shown at FIG. 12.

FIG. 13 is a flow chart that illustrates the details of the ink tank removal and mounting processing. In the removal and mounting processing, when the cover is open, the continuous unmounted time of ink tanks is timed. First, at step S201, the tank that will be subject to the present processing is selected among the ink tanks 1K, 1PGK, 1Y, 1M and 1C. Next, at step S202, a checking processing is performed. In this checking processing, the apparatus main body side control circuit 300 first sends a data signal that includes the [COLOR ID] of the ink tank selected at step S201 and the [CALL] code to the control circuits 103 of the ink tanks. The tank side control circuits 103, which have received the [CALL] code, check whether or not there is agreement between the color ID included in the sent data signal and the color ID stored in their own memory 103B. When color ID agreement is confirmed, the control circuit 103 sends a response signal to the main body side control circuit 300. On the other hand, when color. ID agreement can not be confirmed, the control circuit 103 does not send a response signal to the control circuit 300.

Next, at step S203, the main body side control circuit 300 checks whether there is a response from the control circuit(s) 103 of the ink tank(s) subject to the processing. If the control circuit 300 can not confirm a response it determines that the ink tank selected at step S201 has not been mounted on the carriage, and proceeds to step S204. On the other hand, if the control circuit 300 confirms a response from a control circuit 103 it determines that the ink tank selected at step S201 has been mounted on the carriage, and proceeds to step S205. After passing the processing at steps S204 and S205, processing with respect to one ink tank is completed. The next ink tank to be subject to this ink tank removal and mounting processing is then selected (S201) in order and the process is repeatedly performed until it is detected that the main body cover 201 is closed.

The details of steps S204 and S205 will be explained next. In the processing of step S204, as information concerning the ink tank selected at step S201, data that denotes that the ink tank is not mounted (currently unmounted) is first stored in the RAM 302 of the printer. Also, making reference to the corresponding ink tank's prior ink tank removal and mounting result, stored in the RAM 302, it is determined whether or not it has changed from being currently mounted to currently unmounted. In the case where it has changed from being currently mounted to being currently unmounted, timing of the ink tank's unmounted time interval is started. It should be noted that in the first ink tank removal and mounting processing of the ink tank, timing of the unmounted time interval is commenced in the case where it has been determined that there is no response at step S203 and the processing of step S204 is performed, that is, in the case where it has been determined that that it has been unmounted from the start.

On the other hand, in the processing of step S205, as information relating to the ink tank selected at step S201, data that denotes that the ink tank is mounted (currently mounted) is first stored in the RAM 302 of the printer. Also, making reference to the corresponding ink tank's previous ink tank removal and mounting result, stored in the RAM 302, it is determined whether or not it has changed from being currently unmounted to currently mounted. In the case where it has changed from being currently unmounted to being currently mounted, timing of the ink tank's unmounted time interval is completed and the timed result is stored in the RAM 302. It should also be noted that in the case where, during the timing of the unmounted time interval, it is detected that the main body cover 201 is closed, and the ink tank removing and mounting processing has ended, the timing of the unmounted time interval ends at the same time.

Then, when the cover is closed, it is determined whether or not the unmounted time interval exceeds a prescribed time interval, and in the case where it exceeds the prescribed time interval, a recovery flag is posted at a prescribed area of the RAM 302. Next, only in the case where it is determined that the later described optical checking processing S110 of FIG. 12 has completed normally, a suction-based recovery operation is performed by the recovery unit on the basis of the recovery flag.

Referring again to FIG. 12, when it is detected at step S106 that the main body cover 201 has been closed, a mounting confirmation processing is carried out at step S113.

Figures 14, 14A:
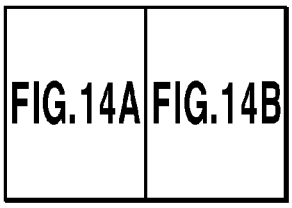
FIG. 14 is a diagram showing a relationship between FIG. 14A and FIG. 14B, and FIGS. 14A and 14B are flow charts illustrating details of the apparatus confirmation processing shown at FIG. 12.
Figure 14B:
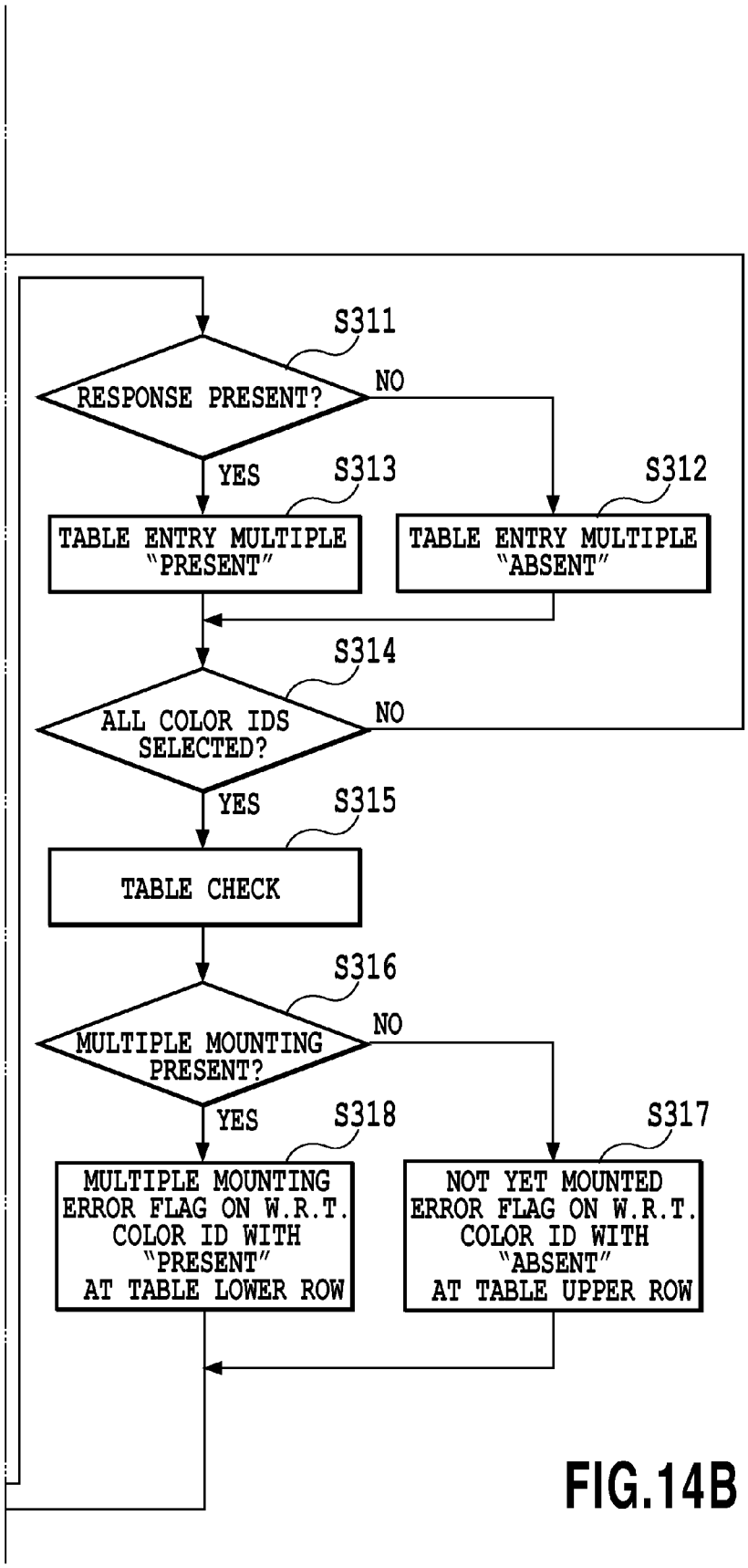

FIGS. 14A and 145 are flow charts that illustrate the details of the mounting confirmation processing.

In the present processing, first, at step S301, the main body side control circuit 300 creates a table for confirmation of color ID. That is, it checks, by a processing that is the same as the checking processing at step S202 of FIG. 13, whether or not all of the color IDs that correspond to the ink tanks that should be mounted on the carriage are provided. In other words, it checks whether or not the five ink tank types (1K, 1PGK, 1Y, 1M, 1C) are mounted in the carriage. More specifically, the main body side control circuit 300 sends data signals containing the [COLOR ID] code and the [CALL] code, and checks responses from the control circuits 103, while sequentially changing the [COLOR ID] in accordance with the five ink tank types. Thus as shown in FIGS. 15A to 15C, information is written at the [COLOR ID Presence/Absence] row (the upper row) of the table, based on the result of this check. For example, when a response could be confirmed with respect to all of the five ink tanks, "Present" is written in all of the columns at the [COLOR ID Presence/Absence] row, as shown in FIG. 15A. Also, for example, where a response from the ink tank 1M (M-ink) could not be confirmed but responses from the other ink tanks could be confirmed, "Absent" is written at the [COLOR ID Presence/Absence] row of the M column, while "Present" is written in the other columns, as shown in FIG. 156.

Figures 16, 16A:
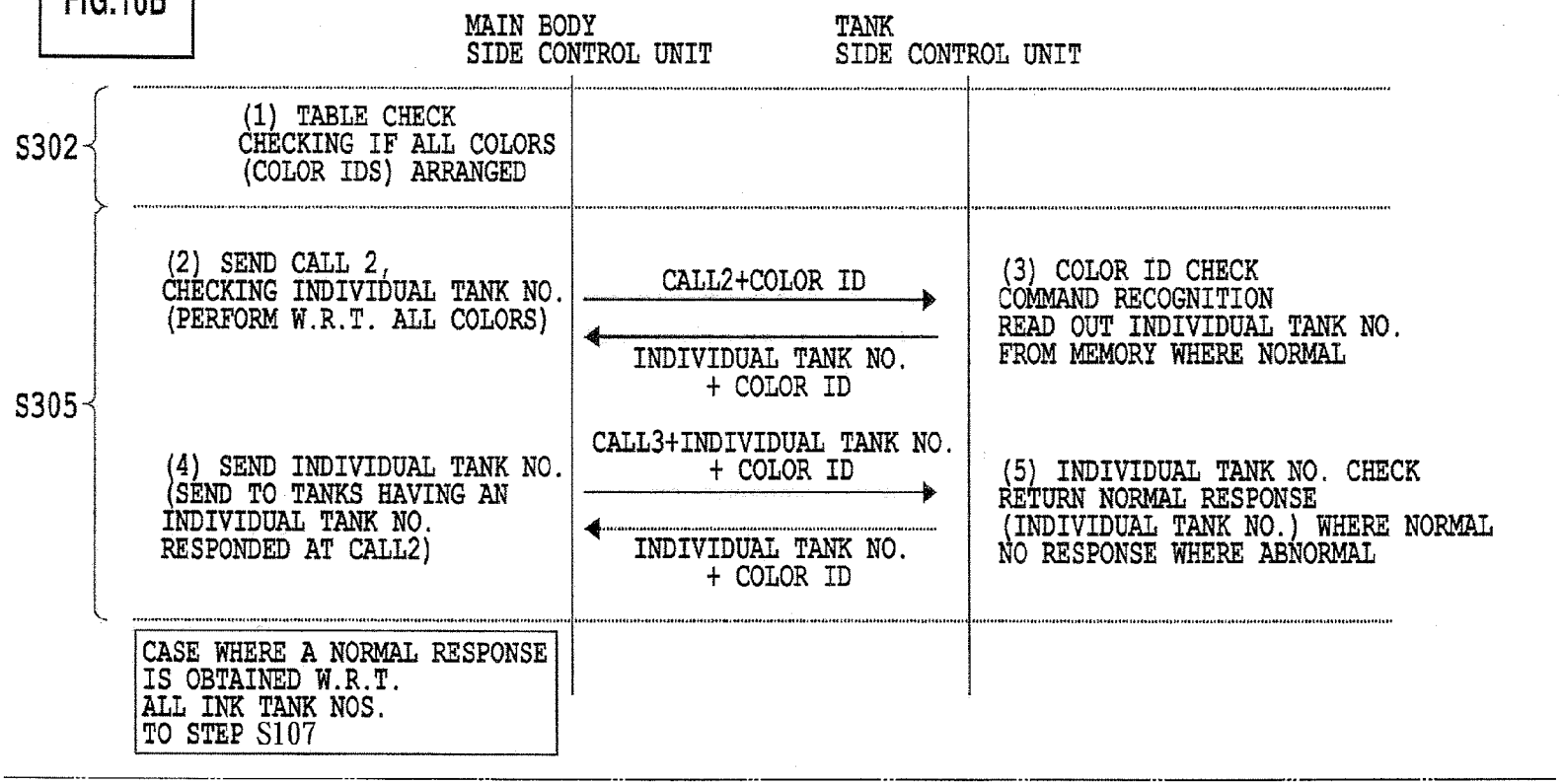
FIG. 16 is a diagram showing a relationship between FIG. 16A and FIG. 16B, and FIGS. 16A and 16B are diagrams that, with respect to the processing shown at FIGS. 14A and 14B, explain the signals exchanged between the main body side control circuit and the tank side control circuits.
Figure 16B:
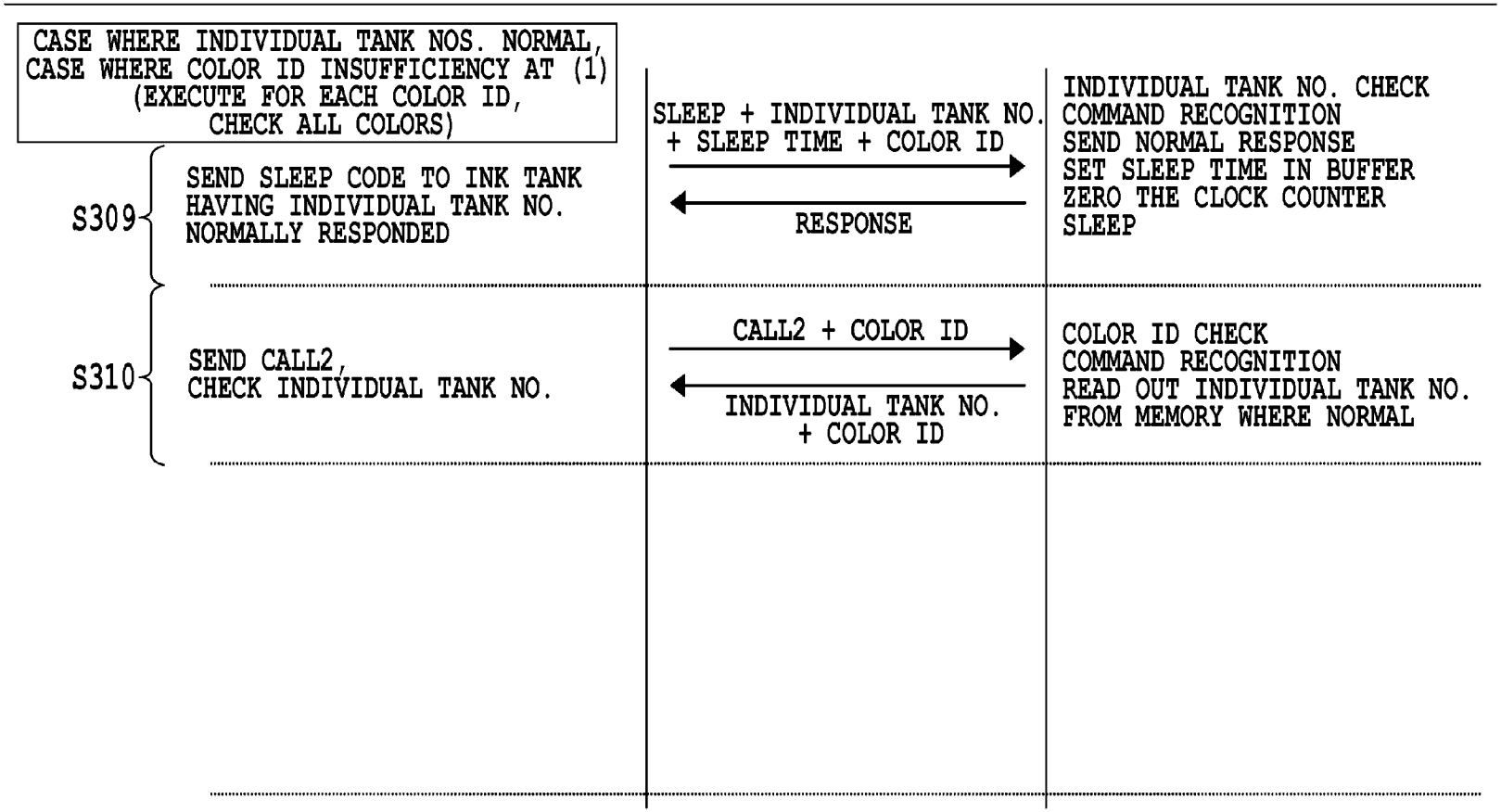

Next, at step S302, while making reference to the table created at step S301, it is determined whether or not there is an ink tank that is not mounted, that is, whether or not there is a lack of color IDs (refer to step S302 of FIG. 16A). Here, as shown in FIG. 15A, in the case where the data at the [ID Presence/Absence] row of all of the columns is "Present", that is, when it is determined that all of the ink tanks are mounted, at step S303 the normal mounting flag is set to ON and the present processing is completed.

On the other hand, when it is determined that there lack of color IDs, processes after step S304 are performed that check whether there is a tank that is not yet mounted and there are plural and same color tanks being mounted. First, at step S304, the color ID that is the subject of the subsequent checking processes is selected from among that of the five ink tanks. Next, with respect to that selected color ID, first, at step S305, an individual tank number checking processing is performed.

More specifically, as shown by step S305 of FIG. 16A, the main body side control circuit 300 sends the color ID and control code [CALL2] to the tank side control circuits 103. In response to this, the respective tank side control circuits 103 compare the color ID contained received control signal to the color ID stored in their memories. In the case where there is color ID agreement, the corresponding tank side control circuit 103 sends its individual tank number, along with the color ID, to the main body side control circuit 300. Next, the main body side control circuit 300 sends the individual tank number that it has received, the color ID, and a control code [CALL3] to the tank side control circuits 103, to request the control circuit(s) 103 of the ink tank(s) having the color ID for which individual tank number(s) is sent, to return a response as to whether or not there is agreement between the individual tank number contained in the control signal and the individual tank number stored in its memory. In response to this, the tank side control circuit(s) 103 determines whether or not there is agreement between the individual tank number sent from the main body side control circuit 300 and the individual tank number stored in its memory, and in the case where there is agreement, returns that individual tank number, along with the color ID, to the main body side control circuit 300 as the above response. On the other hand, in the case where there is not individual tank number agreement it does not respond.

After the individual tank number check of step S305 above, at step S306, it is determined whether or not there is a response from the tank side control circuits 103 to the effect that there is agreement as above. Here, when there is not a response, at step S307, with respect to the selected color ID, "Present" information is written at the [Multiple Presence/Absence] row of the corresponding columns as shown in FIGS. 15A to 15C, and at step S308 the error flag is set to ON and the present processing is completed. That is, the determination at step S306 that there is not a response means that the individual tank number sent along with [CALL3] at step S305 by the main body side control circuit 300 is different than the individual tank number stored in the memory of the ink tank that sent its individual tank number as a response to [CALL2].

For example, if it is assumed that two ink tanks having the same color ID have been mounted, the [CALL2] code sent at the processing of step S305 is effective at the two ink tanks having the same color ID and therefore each return differing individual tank numbers. As a result, a response signal (individual tank number) collision as described above at FIG. 1 occurs, and an individual tank number that is different than each of the above two ink tanks is sent to the main body side control circuit 300. Then, the main body side control circuit 300 sends this different individual tank number to the ink tanks having the selected color ID, that is, to the above two ink tanks having the same color ID, and checks whether there is agreement. As a result, as described above, each of the ink tanks do not respond because agreement of individual tank numbers is not confirmed.

At step S306, when there is a response to the effect that there is agreement of individual tank numbers, next, at step S309 a sleep processing is performed. As shown at step S309 of FIG. 16B, this sleep processing specifies, by color ID and individual tank number, the ink tank that has responded with an individual tank number agreement at step S305 and puts the specified ink tank in a sleep state (non-response state) of a predetermined time interval. For this, the main body side control circuit 300 sends a control signal, which includes the above color ID and individual tank number, [SLEEP] code and SLEEP time interval, to the control circuits 103. Next, the respective tank side control circuits 103 determine whether the color. ID and individual tank number sent from the main body side control circuit 300 agree with the color ID and individual tank number stored in their own memories. Then the ink tank that confirms an agreement turns into a sleep state (non response state) for the SLEEP interval contained in the above control signal.

Next, at step S310, an individual tank number checking processing is performed. In particular, as shown at step S310 of FIG. 16B, an ink tank is specified by the selected color ID, a control code [CALL2] is sent to the tank side control circuits 103, and an individual tank number is requested. In response to this, the control circuit 103 of the ink tank specified by that color ID sends its individual tank number stored in its memory to the main body side control circuit 300. On the other hand, in the case where the sent color ID does not match, the control circuit 103 does not respond.

Next, at step S311, the main body side control circuit 300 determines whether or not there is an individual tank number transmission (response) from the ink tank side. Here, in the case where there is a response, "Present" (multiple mounting) information is written at the [Multiple Present/Absent] row of the corresponding column of the tables as shown at FIGS. 15A to 15C, and in the case where there is not a response "Absent" (not yet mounted) information is written at the [Multiple Present/Absent] row of the corresponding column.

Figure 2:
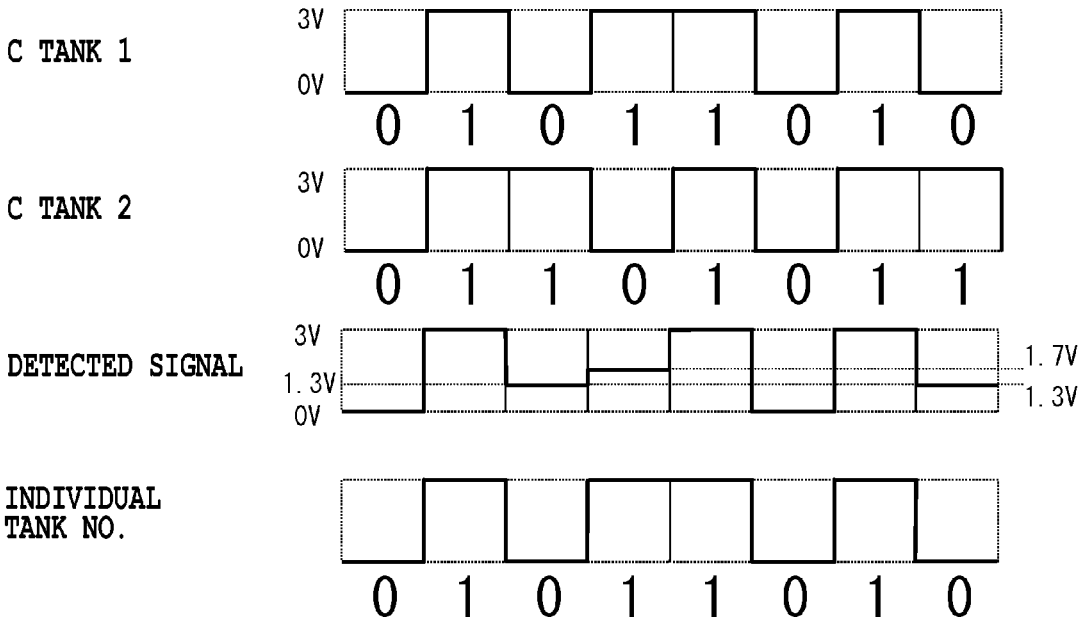
FIG. 2 is a waveform diagram showing, at the time when multiple ink tanks are mounted, the response waveforms sent by the respective tank side control circuits, the collision waveform detected by the main body side control circuit, and the detected individual tank number in a case where the main body control circuit threshold value has changed.
Figure 3:
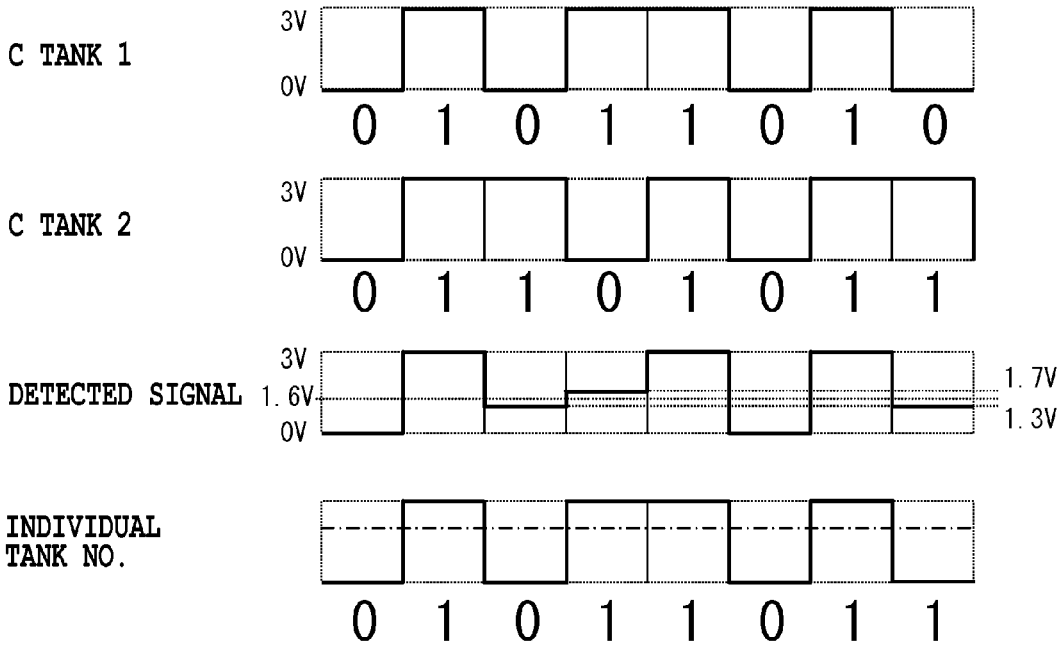
FIG. 3 is a waveform diagram showing, at the time when multiple ink tanks are mounted, the response waveforms sent by the respective tank side control circuits, the collision waveform detected by the main body side control circuit, and the detected individual tank number in a case where the detection threshold value of the main body side control circuit has changed.
Figure 17:
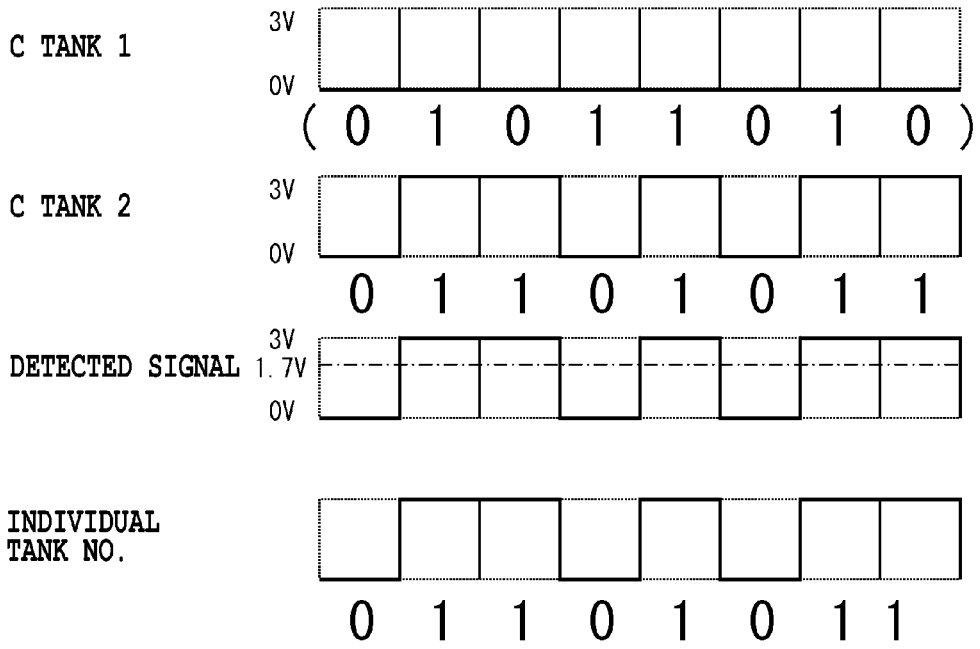
FIG. 17 is a diagram that shows ink tank response signals of the individual tank number confirmation processing shown at FIGS. 14A and 14B and the detected signal based thereon.

FIG. 17 is a diagram that shows, in the case where it has been determined that there is a response at step S311, the response signal of the ink tank during the processing of step S310 and the detected signal based thereon, and is similar to the figures of FIG. 2 and FIG. 3. FIG. 17 illustrates an example of a case where two cyan ink tanks (C tank 1, C tank 2) are mounted. As shown in FIG. 17, C tank 1 has been put in a sleep state by the processing at step S309 and is in a state where it can not respond at the individual tank number checking processing of step S310. That is, this example is a case where, in the individual tank number checking processing at step S305, usually it is determined that individual tank number agreement can not be confirmed due to the collision of response signals (individual tank numbers) from the two cyan tanks 1 and 2, but because the detected individual tank number changes due to the influence of the above described main body side control circuit threshold value or individual differences among tank side control circuit outputs, the agreement, as the individual tank number of C tank 1, can be confirmed (refer to FIGS. 2 and 3). To deal with this, the present embodiment, as shown in FIG. 17, puts the control circuit of tank C1, which has the individual tank number whose agreement could be confirmed, in a sleep state, and sends the control code [CALL2] with specifying ink tanks by the same color ID. Thereby, C tank 2, designated with the same color ID, is able to return its individual tank number, and the main body side control circuit 300 detects its individual tank number "01101011". Because of this it is possible to determine that multiple ink tanks with the same color ID are mounted, due to the determination at step S311 that there was a response.

On the other hand, in the case where it is determined that there is not a response at step S311, it is the case where the color ID sent from the main body side control circuit 300 does not match, that is, the case where no ink tank of that color ID is mounted, and then "Absent", that is, "multiple mounting absent" is written at the corresponding columns of the table.

In the above manner, according to the processing of steps S309 to S312, even in the case where there is a collision of response signals due to the mounting of multiple ink tanks of the same color, it is possible to discriminate, with a high degree of accuracy, whether or not multiple ink tanks are mounted.

It should be noted that, concerning the processing at step S309 of FIG. 14A, it has become possible to determine at the main body side control circuit 300 whether the tank side control circuit 103 has been normally put into a sleep state by way of it responding to the main body side control circuit 300 that it has normally received the [SLEEP] command. The tank side control circuit 103, as described above, judges agreement between the individual tank number contained in the control signal and the individual tank number stored in its own memory, and judges commands, and in the case where a [SLEEP] command is recognized, the SLEEP time interval contained in the command is set in the register 103E. Next, the value of the clock counter 103F is cleared to "0" and counting of the clock signal input from the main body side control circuit 300 is commenced. Next, the control circuit 103 repeats clock counting until the value of the clock counter 103F agrees with the value of the register 103E, and during this interval turns to a state wherein it does not respond to control signals from the apparatus side control circuit (a sleep state).

Here, the SLEEP time interval is a time interval viewed from the main body side control circuit 300; the control circuit 103 turns to a SLEEP state during the clock specified by the main body side control circuit 300 and becomes responsive after its expiration; and time is not counted in the case, for example, where the clock input into the control circuit 103 has halted. Also, the above is but one example of count commencement; for example the count may be started immediately after reception and the response transmission time after reception of the SLEEP command added after the count has completed, that is, it is acceptable if a response to the request is not made on the same clock baseline as that of the main body side control circuit 300. Furthermore, measurement of the SLEEP time interval may be done by methods such as a method that counts the clock signal input into the control circuit 103, or a method, apart from a clock signal input into the control circuit 103, which internally changes and counts the clock number and sends a response after the SLEEP time interval has elapsed, that is, it is acceptable if a response to the request is not made on the same clock baseline as that of the main body side control circuit 300.

After the above processing, at step S314, it is determined if all of the color. IDs have been selected or not, and in the case of non-completion, the processing after step S305 are repeated. When the above processing are completed with respect to all color IDs, at step S315 the created table shown in FIGS. 15A to 15C are referenced, and at step S316 it is determined, for example, whether or not multiple ink tanks of the same color ID are mounted. FIG. 15A illustrates a case of normal mounting. On the other hand, FIG. 15B illustrates a case where the M ink tank has not yet been mounted and there is no multiple mounting. In this case, at step S317 a not yet mounted flag is set to ON with respect to the M ink tank and the present processing is completed. FIG. 15C illustrates a case where the M ink tank has not yet been mounted, and two C ink tanks have been mounted. In this case, at step S318 a multiple mounted flag is set to ON with respect to the C ink tank and the present processing is completed. In this way, according to the present embodiment, it is possible to discriminate, with good precision, among these three cases.

Referring again to FIG. 12, after the above mount checking processing at step S113, at step S107 it is determined, based on the state of the above flag, whether or not mounting is normal. Here, when it is determined that it is not normal, at step S108, error indication is performed, which classifies unmounted or multiple mounted. This error indication may take place at a display panel (not shown) of the ink jet printer, it may take place at a external device (for example, a PC screen), connected to the ink jet printer, or it may take place in both of the above forms. In the case where error indication is performed at the ink jet printer display panel (not shown), a signal for notifying unmounted or multiple mounted is output to the display panel from the control circuit 300. On the other hand, in the case where error indication is performed at an external device (for example, a PC screen) connected to the ink jet printer, a signal for notifying unmounted or multiple mounted is output to the external device from the control circuit 300. When it is determined at step S107 that mounting is normal, the process proceeds to the optical checking processing of step S109.

The optical checking processing is an processing wherein light from the light emitting units 101 is received by the light reception unit 210, and based on the light reception outcome it is determined whether or not the ink tanks are mounted at the correct position. The optical checking processing is based on a principle wherein, in the case where the light emitting units 101 of the ink tanks 1 are caused to emit light, the result of the reception of that light at the light reception unit 210 will differ in the case where the ink tanks 1 are mounted correctly in the mounting unit and in the case where they are not, although the location of the carriage 205 is the same. For example, the control circuit 300, in the case where the carriage 205 is at a predetermined location, specifies a color ID and sends an order to turn on a light (a light emission command) to the common wiring, making use of the light reception outcome at the light reception portion 210 in respect to the light emission of the light emitting unit 101 of the designated ink tank, it is determined whether or not the specified ink tank is mounted at the correct position.

In this case, the color ID that corresponds to a location of the carriage 205 and is to be subjected to the light-on order may be established in advance. A mode wherein one color to be subject to a light-on order, is assigned to each of the multiple locations of the carriage 205 (for example, such that yellow ink is assigned to the location where the mount for the ink tank 1Y faces the light reception unit and magenta ink is assigned to the location where the mount for the ink tank 1M faces the light reception unit) is conceivable as one embodiment of this case. Thus, at each of the above multiple locations, by causing the light emitting unit of the above described one ink tank subject to the light-on command to light, and making use of the amount of light detected by the light detection unit 210 at these times (the light reception results accompanying light emissions at the multiple positions), it can be determined whether or not the ink tanks are mounted in the correct position. In other words, when determining whether or not an ink tank of a specified color (for example, the ink tank 1Y) is mounted in the mount for that specified color, the light reception result with respect to the light emitted by the ink tank of the specified color when the mount for the specified color is in a state where it faces the light reception unit (the facing light reception amount), is utilized. An example of such an optical checking processing is disclosed in U.S. Patent publication No. 2005/0179750.

An example with yellow ink will now be described. In the case where the ink tank 1Y is mounted in the mount for the ink tank 1Y (the Y mount), the ink tank 1Y emits light in a state where it faces the light reception unit. Thereupon at this time the received light amount is comparatively large because light is received head-on by the light receiving unit. On the other hand, in the case where the ink tank 1Y is incorrectly mounted in a mount differing from the Y mount (any of the M, K, or C mounts), the ink tank 1Y emits light in a state where it does not face the light reception unit. Thereupon at this time the received light amount is comparatively small because light is received at an angle by the light receiving unit. In this way, because there is a light reception outcome difference between the case where the mounted position is correct and incorrect, by setting an appropriate threshold value and determining whether or not the amount of received light has exceeded that threshold value it is possible to determine whether or not the mounting position is correct. In the present example, if the amount of received light exceeds the threshold value because the light is received head-on it is possible to determine that the ink tank 1Y is mounted in the Y mount, and if the amount of received light does not exceed the threshold value because the light is not received head on it is possible to determine that the ink tank 1Y is not mounted in the Y mount, that is, that a mounting position error has occurred.

A mode where two or more ink types subject to a light-on order are assigned to each of the multiple locations of the carriage 205 (for example, such that yellow ink, magenta ink and black ink are assigned to the location where the mount for the ink tank 1Y faces the light reception unit and magenta ink, cyan ink and yellow ink are assigned to the location where the mount for the ink tank 1M faces the light reception unit) is also conceivable as a different embodiment. In this case, at each of the above multiple locations, by causing the light emitting units of the above described multiple ink tanks subject to the light-on command to light sequentially, and making use of the amount of light detected by the light detection unit 210 at these times (the light reception results accompanying the successive light emissions at the respective multiple positions), it can be determined whether or not the ink tanks are mounted in the correct position. In other words, when determining whether or not an ink tank of a specified color (for example, the ink tank 1Y) is mounted in the mount for that specified color, in addition to utilizing the light reception result (the facing light reception amount) with respect to the light emitted by the ink tank of the specified color when the mount for the specified color is in a state where it faces the light reception unit, the light reception result (the not-facing light reception amount) with respect to the light emitted by the ink tank of the specified color when the mount for the specified color is in a state where it does not face the light reception unit (a state wherein a mount of another color faces the light reception unit), is also utilized. An example of such an optical checking processing is disclosed in Published U.S. Patent publication No. 2006/0284911.

It is also acceptable to sequentially change the type of ink that is subject to the light-on order at a single position of the carriage 205 and determine whether or not the ink tanks are mounted at the correct position. For example, the carriage 205 is moved to and stopped such that the mount for the ink tank 11 faces the light reception unit 210, and the Y, M, C, etc. ink type that is subject to the light-on command is sequentially changed and caused to emit light. If the amount of light received by the light reception unit is at its strongest at the time when the light-on signal subject to Y is sent, it can be determined that the ink tank 1Y is mounted in the mount for the ink tank 1Y.

After the above described optical checking processing, at step S110, based on the optical checking processing, it is determined whether the optical checking processing has completed normally or not. In the case where there is normalcy, an indication to that effect is carried out at step S111. For example, the lamp, which is a display device at the operation panel 213, is lit to green. On the other hand, in the case of an abnormality, an indication to that effect is carried out at step S112. For example, the lamp, the display device at the operation panel 213, is lit to orange, and the LED of the ink tank with an incorrect mounted position is lit. Accordingly, the processing of FIG. 12 is completed.

(Other Embodiments)

A tank side control circuit 103, when it has received a sleep command after sending its individual tank number to the main body side control circuit 300, may change its output impedance during the specified sleep time interval, for example, to make an output close to low level. For example, the tank side control circuit 103 may have a have an output impedance measuring circuit, and in the case where, at the time of responding, a voltage exists that is outside its own electric potential, after receiving a SLEEP command, the tank side control circuit 103 may have a circuit that turns it into a SLEEP state that does not transmit one signal.

Figure 18:
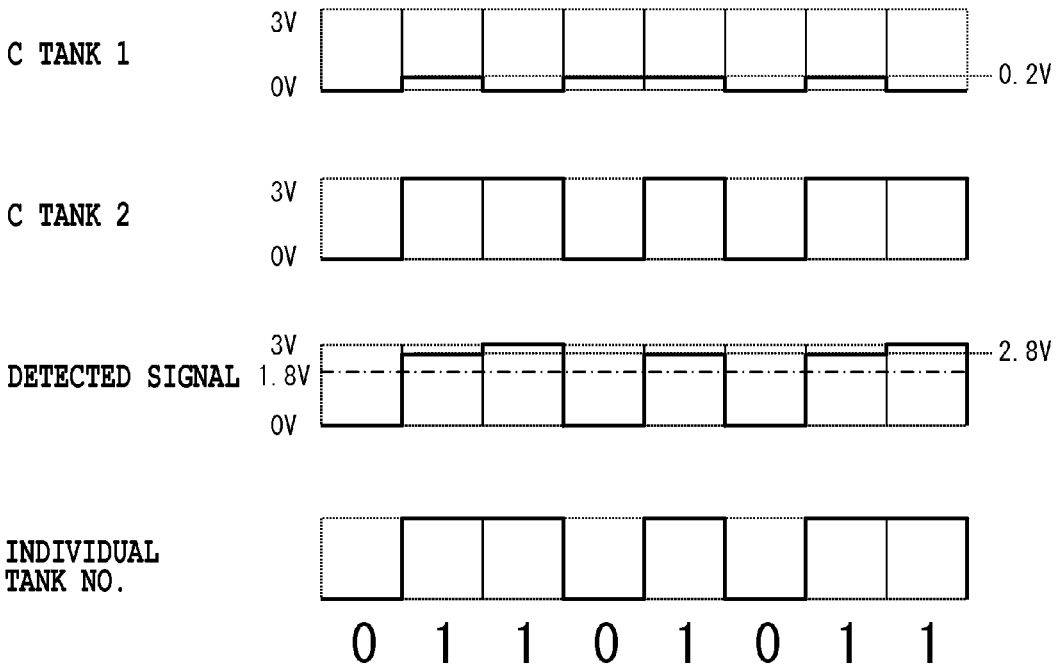
FIG. 18 is a diagram that, in connection with another embodiment, shows ink tank response signals of an individual tank number confirmation processing and the detected signal based thereon.
Figure 19:
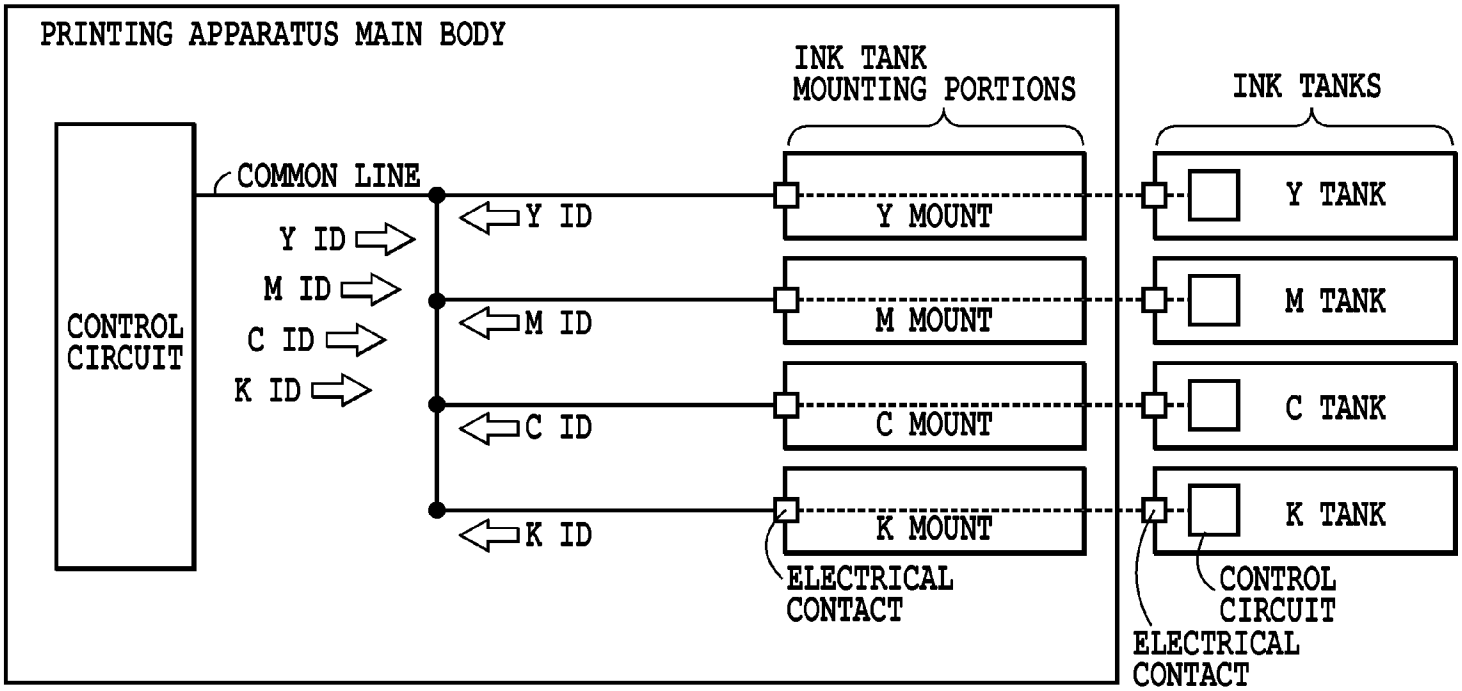
FIG. 19 is a diagram for explaining the determination of the 4 color mounting state of ink tanks (in particular, a state where ink tanks of 4 different colors are arranged) by way of using a structure wherein the control circuit of the printing apparatus main body and the 4 colored ink tanks are bus-connected.
Figure 20:
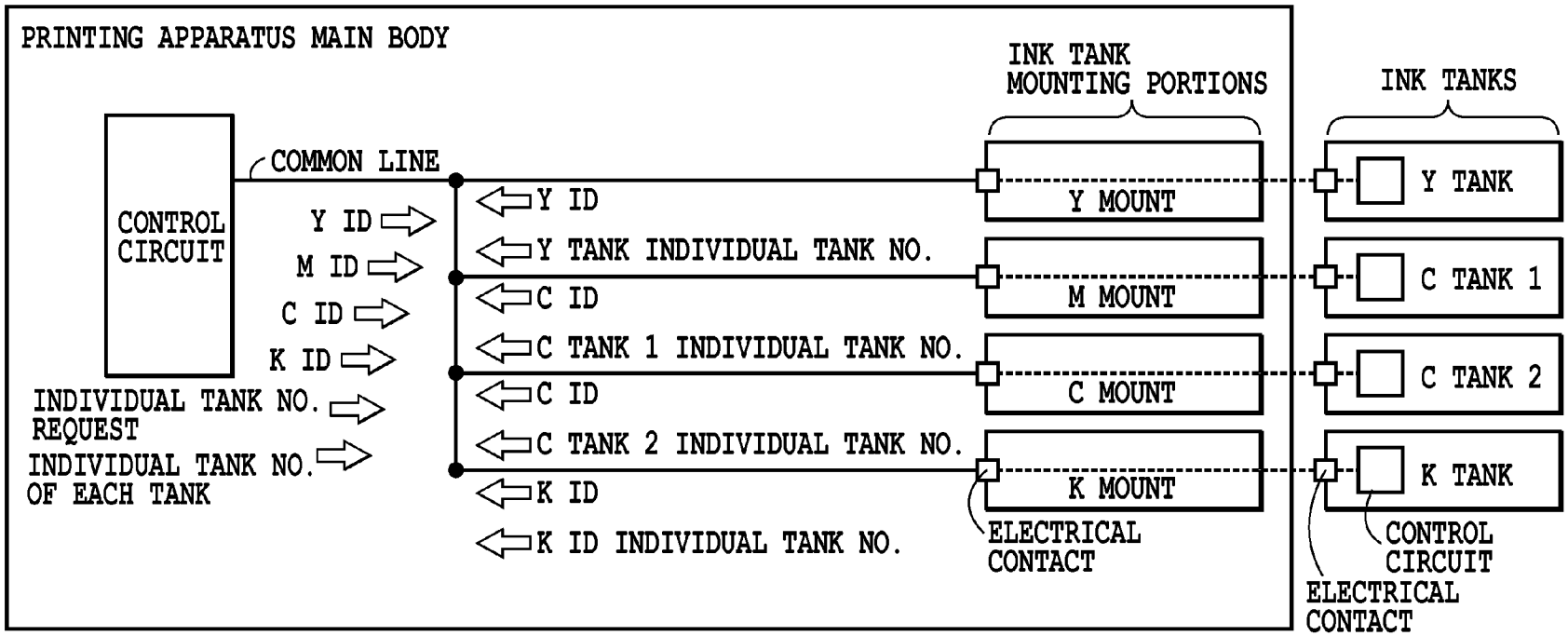
FIG. 20 is a diagram for explaining the determination of the 4 color mounting state of ink tanks (in particular, a state where multiple C ink tanks are mounted) by way of using a structure wherein the control circuit of the printing apparatus main body and the 4 colored ink tanks are bus-connected.

For example, as shown in FIG. 18, the control circuit of C tank 1 that received a SLEEP command from the main body side control circuit 300 lowers its own output to the order of 0.2V. At this time, the control circuit of C tank 2 outputs at a normal voltage. Herewith, the detected signal, which is a response signal collision waveform, becomes the collision voltage as shown in the same figure. Because the threshold value of the main body side control circuit is set near the midpoint voltage between the high side voltage and the low side voltage, if the collision voltage is on the order of 2.8V, proper detection may be had even if at a 1.8V threshold value.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-045880, filed Mar. 2, 2010, which is hereby incorporated by reference herein in its entirety.

What is claimed is:

1. An ink jet printer for printing using an inkjet head configured to eject a plurality of different types of inks, comprising:

a mounting portion to which a plurality of ink tanks are detachably mountable, wherein each of the ink tanks contains an ink to be supplied to the inkjet head, and has a memory storing (a) type information indicative of a type of the ink contained in the ink tank and (b) individual information of the ink tank;

a common wiring capable of electrically connecting in common with the ink tanks mounted on the mounting portion; and a controlling unit electrically connected with the common wiring and capable of communicating with the ink tanks through the common wiring, wherein the controlling unit is configured:

(i) to select one of multiple pieces of type information corresponding to the different types, respectively, (ii) to send, to the common wiring, a send command for requesting one or more ink tanks having the selected type information to send individual information stored in the memory, (iii) to receive, from the common wiring, the individual information as a response to the send command, (iv) to send, to the common wiring, a non-response command for putting the ink tank having the received individual information into a non-response state during a predetermined period where the ink tank does not respond to the send command, and (v) to send, to the common wiring, the send command in the predetermined period, and to determine that at least two ink tanks having the selected type information are mounted on the mounting unit if the controlling unit receives individual information as a response to the send command from the common wiring.

2. An ink jet printer according to claim 1, wherein the controlling unit is configured to determine that at least two ink tanks having the selected type information are not mounted on the mounting unit if the controlling unit does not receive the individual information as the response to the send command from the common wiring.

3. An ink jet printer according to claim 1, further comprising the plurality of ink tanks, wherein each of the plurality of the ink tanks has a controller configured:

(i) to receive, from the common wiring, the send command together with the selected type information, (ii) to send, to the common wiring, the individual information stored in the memory as the response to the send command received from the common wiring, if the selected type information received from the common wiring is the same as the type information stored in the memory, and (iii) to receive, from the common wiring, the non-response command together with the individual information and to put the controller into the non-response state in response to the non-response command received from the common wiring if the individual information received from the common wiring is the same as the individual information stored in the memory.

4. An ink jet printer for printing using an inkjet head configured to eject a plurality of different types of inks, comprising:

a mounting portion to which a plurality of ink tanks are detachably mountable, wherein each of the ink tanks contains an ink to be supplied to the inkjet head, and has a memory storing (a) type information indicative of a type of the ink contained in the tank and (b) individual information of the ink tank;

a common wiring capable of electrically connecting in common with the ink tanks mounted on the mounting portion; and a controlling unit electrically connected with the common wiring and capable of communicating with the ink tanks through the common wiring, wherein the controlling unit is configured:

(i) to select one of multiple pieces of type information corresponding to the different types, respectively, (ii) to send, to the common wiring, a first command for requesting one or more ink tanks having the selected type information to send individual information stored in the memory, (iii) to receive, from the common wiring, the individual information as a response to the first command, (iv) to send, to the common wiring, a second command for putting the ink tank having the received individual information into a non-response state during a predetermined period where the ink tank having the received individual information does not respond to a third command for requesting one or more ink tanks having the selected type information to send a response, and (v) to send, to the common wiring, the third command in the predetermined period and to determine that at least two ink tanks having the selected type information are mounted on the mounting portion if the controlling unit receives the response to the third command from the common wiring.

5. An ink jet printer according to claim 4, wherein the controlling unit is configured to determine that at least two ink tanks having the selected type information are not mounted on the mounting portion if the controlling unit does not receive the response to the third command from the common wiring.

6. An ink jet printer according to claim 4, wherein the third command is the same as the first command.

7. An ink jet printer according to claim 4, further comprising the plurality of ink tanks, wherein each of the plurality of the ink tanks has a controller configured:

(i) to receive, from the common wiring, the first command together with the selected type information, (ii) to send, to the common wiring, the individual information stored in the memory as the response to the first command received from the common wiring, if the selected type information received from the common wiring is the same as the type information stored in the memory, and (iii) to receive, from the common wiring, the second command together with the individual information and to put the controller into the non-response state in response to the second command received from the common wiring if the individual information received from the common wiring is the same as the individual information stored in the memory.

8. An ink jet printer, comprising:

a mounting portion to which a plurality of ink tanks are detachably mountable, wherein each of the ink tanks has a memory storing (a) type information indicative of a type of ink contained in the ink tank and (b) individual information of the ink tank;

a common wiring capable of electrically connecting in common with the ink tanks mounted on the mounting portion; and a controlling unit electrically connected with the common wiring and capable of communicating with the ink tanks through the common wiring, wherein said controlling unit is configured:

(i) to receive the type information from each of the ink tanks through the common wiring, (ii) to specify one of one or more kinds of the received type information, (iii) to send, to the common wiring, a send command for requesting one or more ink tanks having the specified type information to send individual information stored in the memory, (iv) to receive, from the common wiring, the individual information as a response to the send command, (v) to send, to the common wiring, a non-response command for putting the ink tank having the received individual information into a non-response state during a predetermined period where the ink tank does not respond to the send command, and (vi) to send, to the common wiring, the send command in the predetermined period, and to determine that at least two ink tanks having the specified type information are mounted on the mounting portion if the controlling unit receives the individual information as a response to the send command from the common wiring.

9. An ink jet printer according to claim 8, wherein the controlling unit is configured to determine that at least two ink tanks having the specified type information are not mounted on the mounting portion if the controlling unit does not receive the individual information as the response to the send command from the common wiring.

10. An ink jet printer according to claim 8, further comprising the plurality of ink tanks, wherein each of the plurality of the ink tanks has a controller configured:

(i) to send, to the common wiring, the type information stored in the memory, (ii) to receive, from the common wiring, the send command together with the specified type information, (iii) to send, to the common wiring, the individual information stored in the memory as the response to the send command received from the common wiring, if the specified type information received from the common wiring is the same as the type information stored in the memory, (iv) to receive, from the common wiring, the non-response command together with the individual information and to put the controller into the non-response state in response to the non-response command received from the common wiring if the individual information received from the common wiring is the same as the individual information stored in the memory.

11. An ink jet printer, comprising:

a mounting portion to which a plurality of ink tanks are detachably mountable, wherein each of the ink tanks has a memory storing (a) type information indicative of a type of ink contained in the ink tank and (b) individual information of the ink tank;

a common wiring capable of electrically connecting in common with the ink tanks mounted on the mounting portion; and a controlling unit electrically connected with the common wiring and capable of communicating with the ink tanks through the common wiring, wherein said controlling unit is configured:

(i) to receive type information from each of the ink tanks through the common wiring, (ii) to specify one of one or more kinds of the received type information, (iii) to send, to the common wiring, a first command for requesting individual information from one or more ink tanks having the specified type information, (iv) to receive, from the common wiring, the individual information as a response to the first command, (v) to send, to the common wiring, a second command for putting the ink tank having the received individual information into a non-response state during a predetermined period where the ink tank having the received individual information does not respond to a third command for requesting one or more ink tanks having the specified type information to send a response, and (vi) to send, to the common wiring, the third command in the predetermined period and to determine that at least two ink tanks having the specified type information are mounted on the mounting portion if the controlling unit receives the response to the third command from the common wiring.

12. An ink jet printer according to claim 11, wherein the controlling unit is configured to determine that at least two ink tanks having the specified type information are not mounted on the mounting portion if the controlling unit does not receive the response to the third command from the common wiring.

13. An ink jet printer according to claim 11, wherein the third command is the same as the first command.

14. An ink jet printer according to claim 11, further comprising the plurality of ink tanks, wherein each of the plurality of the ink tanks has a controller configured:

(i) to send, to the common wiring, the type information stored in the memory, (ii) to receive, from the common wiring, the first command together with the selected type information, (iii) to send, to the common wiring, the individual information stored in the memory as the response to the first command received from the common wiring, if the selected type information received from the common wiring is the same as the type information stored in the memory, and (iv) to receive, from the common wiring, the second command together with the individual information and to put the controller into the non-response state in response to the second command received from the common wiring if the individual information received from the common wiring is the same as the individual information stored in the memory.

15. An ink tank detachably mountable to an external device, comprising:

a memory storing (a) type information indicative of a type of an ink contained in the ink tank and (b) individual information of the ink tank;

an electrical contact; and a controller configured:

(i) to receive control data from the external device via the electrical contact, (ii) to send the type information and the individual information that are stored in the memory to the external device via the electrical contact, when the received control data includes a first command and first information identical to the type information stored in the memory, (iii) to send the type information and the individual information that are stored in the memory to the external device via the electrical contact, when the received control data includes a second command, the first information and second information identical to the individual information stored in the memory, and (iv) to put the controller into a non-response state where the controller does not respond to the control data sent from the external device, when the received control data includes a third command, the first information, and the second information.

16. An ink tank according to claim 15, wherein if the controller receives the control data including the first command and the first information when the controller is the non-response state, the controller does not send the type information and the individual information to the external device.

17. An ink tank detachably mountable to an external device, comprising:

a memory storing (a) type information indicative of a type of an ink contained in the ink tank and (b) individual information of the ink tank;

an electrical contact; and a controller configured:

(i) to send at least the individual information stored in the memory to the external device via the electrical contact if the controller receives, from the external device via the electrical contact, first information identical to the type information stored in the memory and a send command for requesting the controller to send the individual information; and (ii) to put the controller into a non-response state where the controller does not respond to the send command if the controller receives, from the external device via the electrical contact, the first information, second information identical to the individual information stored in the memory, and a non-response command for putting the controller into the non-response state.

18. An ink tank according to claim 17, wherein if the controller receives the first information and the send command from the external device via the electrical contact when the controller is the non-response state, the controller does not send the individual information to the external device.

* * * * *